US011423747B2

(12) United States Patent
Pegram et al.

(10) Patent No.: US 11,423,747 B2
(45) Date of Patent: Aug. 23, 2022

(54) CRAZY DICE GAMING SYSTEM

(71) Applicant: Michael E. Pegram, Minden, NV (US)

(72) Inventors: Jacob M. Pegram, Gardnerville, NV (US); Michael E. Pegram, Minden, NV (US); Tyler T. Parham, Reno, NV (US)

(73) Assignee: Michael E. Pegram, Minden, NV (US)

( * ) Notice: Subject to any disclaimer, the term of this patent is extended or adjusted under 35 U.S.C. 154(b) by 15 days.

(21) Appl. No.: 16/449,387

(22) Filed: Jun. 22, 2019

(65) Prior Publication Data

US 2020/0402371 A1 Dec. 24, 2020

(51) Int. Cl.

| | |
|---|---|
| ***G07F 17/00*** | (2006.01) |
| ***G07F 19/00*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3211* (2013.01); *G07F 17/3262* (2013.01); *G07F 17/3267* (2013.01); *G07F 17/3295* (2013.01)

(58) Field of Classification Search

CPC .... G07F 17/326; G07F 17/3267; G07F 17/34; G07F 17/3211; G07F 17/3262; G07F 17/3295

See application file for complete search history.

(56) References Cited

U.S. PATENT DOCUMENTS

| | | | | |
|---|---|---|---|---|
| 5,344,145 | A * | 9/1994 | Chadwick | A63F 9/04 463/31 |
| 2002/0169016 | A1* | 11/2002 | Tarantino | G07F 17/3286 463/16 |
| 2003/0064790 | A1* | 4/2003 | Hughs-Baird | G07F 17/3211 463/20 |
| 2004/0152498 | A1* | 8/2004 | Kaminkow | G07F 17/3213 463/16 |
| 2005/0181860 | A1* | 8/2005 | Nguyen | G07F 17/32 463/20 |
| 2007/0021183 | A1* | 1/2007 | Fiden | G07F 17/34 463/17 |
| 2007/0060293 | A1* | 3/2007 | Svanas | G07F 17/32 463/20 |
| 2009/0197665 | A1* | 8/2009 | Christensen | G07F 17/3279 463/20 |

(Continued)

*Primary Examiner* — Milap Shah
*Assistant Examiner* — Jason Pinheiro
(74) *Attorney, Agent, or Firm* — Wolf IP Law, PLCC; Dean E. Wolf, Esq.

(57) ABSTRACT

A wager-based gaming system includes a communication interface, a memory, and a controller configured to provide a video-based wagering game including a primary game, accept a player input, facilitate play, and determine a primary game outcome. The primary game can involve virtual dice arranged in a matrix having multiple rows and multiple columns, such as a 5×5 matrix. A secondary game can involve virtual reels and can occur simultaneously with the primary game. The secondary game outcome can award player changes to the primary game outcome, such as allowing a selection of one or more of the virtual dice to be re-rolled. A bonus game play can involve a wheel spin, can be based on a winning outcome of the secondary game, and can occur after the secondary game.

19 Claims, 17 Drawing Sheets

(56) References Cited

U.S. PATENT DOCUMENTS

| | | | | |
|---|---|---|---|---|
| 2012/0231869 | A1* | 9/2012 | Englman | G07F 17/3244 463/20 |
| 2013/0072289 | A1* | 3/2013 | Nelson | G07F 17/3225 463/25 |
| 2013/0178271 | A1* | 7/2013 | Aponte | G07F 17/34 463/20 |

* cited by examiner

300

CRAZY DICE GAMING SYSTEM

TECHNICAL FIELD

The present invention relates generally to wager-based gaming, and more particularly to wager-based gaming systems playable on a gaming machine.

BACKGROUND

Traditional wager-based gaming systems are typically competitive based on the ability of gaming establishments to increase player bases and the ability of gaming manufacturers to create and sell new and innovative games, devices, and systems. Because of demands that the wager-based gaming industry has created, gaming establishments and manufacturers are constantly searching for new and innovative games for players to play. As examples, video type games such as poker, spinning reels with secondary bonuses, and progressive systems are quite popular with players today. While craps and other dice games tend to be popular with respect to physical gaming tables, there are presently no attractive and commercially available video type games that use dice.

Although traditional gaming systems and methods have worked well in the past, improvements are still desirable. In particular, what is desired are video gaming systems and methods that allow players to enjoy the play of attractive video type wager-based games using dice.

SUMMARY

It is an advantage of the present disclosure to provide new gaming systems and methods that allow players to enjoy the play of attractive video type wager-based games using dice. This can be accomplished at least in part through the use of video type gaming systems and methods that involve at least a primary game having dice arranged in a matrix. The disclosed embodiments generally relate to video type wager-based games, and more specifically to those that utilize multiple dice in game play to create multiple winning opportunities for player. The disclosed gaming systems and methods can include a secondary game and an additional bonus game, and may also include a skill-based aspect.

Various embodiments of the present disclosure include a wager-based gaming system having an interface configured for communication, a memory, and a controller coupled to the interface and the memory. The controller can be configured to execute a plurality of instructions stored in the memory for a variety of process steps. Pertinent process steps can include providing a video-based wagering game including a primary game involving virtual dice arranged in a matrix having multiple rows and multiple columns, accepting an input from the player regarding play of the primary game, facilitating play of the primary game that involves a random determination of the virtual dice, and determining an outcome of the primary game that involves the random determination of the virtual dice.

In various detailed embodiments, the interface can be configured for communication with a player of the wager-based gaming system. Each of the virtual dice can be positioned in exactly one row and exactly one column of the matrix, and the matrix can include exactly five rows and exactly five columns, although other amounts are also possible. The outcome of the primary game can include a row sub-outcome for each row of the matrix and a column sub-outcome for each column of the matrix, as well as a scatter sub-outcome for all dice in the matrix.

The controller can be further configured to execute instructions stored in the memory for providing multiple awards to the player based on the outcome of the primary game. Additional instructions can include those for providing a secondary game associated with the primary game, with the secondary game involving virtual reels, as well as facilitating play of the secondary game that involves a random determination of the virtual reels, and determining an outcome of the secondary game that involves the random determination of the virtual reels. The play of the secondary game can occur simultaneously with play of the primary game.

In further detailed embodiments, the outcome of the secondary game can allow player changes to the outcome of the primary game, and the player changes can include a skill-based aspect. The player changes can include selecting one or more of the virtual dice in the matrix to be re-rolled. Still further processor instructions can include those for providing a bonus game associated with the secondary game, awarding a bonus game play based on a winning outcome of the secondary game, where the winning outcome does not include all possible outcomes of the secondary game, and determining an outcome of the bonus game play. This bonus game play can occur after the play of the secondary game, and can involve spinning a virtual wheel.

Further embodiments of the present disclosure include various computer readable media including at least computer program code for presenting a wager-based game using a computing apparatus. At least one computer readable medium can include computer program code for providing to a player via a computing apparatus a video-based wagering game including a primary game, the primary game involving virtual dice arranged in a matrix having multiple rows and multiple columns. As in the foregoing embodiments, each of the virtual dice can be positioned in exactly one row and exactly one column. The computer readable medium can also include computer program code for accepting an input from the player regarding play of the primary game, computer program code for facilitating play of the primary game involving a random determination of the virtual dice, and computer program code for determining an outcome of the primary game based upon the random determination of the virtual dice.

In various detailed embodiments, the computer readable medium can also include computer program code for providing to the player via the computing apparatus a secondary game associated with the primary game, the secondary game involving virtual reels. Each of the virtual reels can be associated with one of the columns of the matrix. Additional computer program code can include that for facilitating play of the secondary game involving random determination of the virtual reels, and that for determining an outcome of the secondary game involving the random determination of the virtual reels. Still further computer program code can include that for providing to the player via the computing apparatus a bonus game associated with the secondary game, that for awarding a bonus game play to the player based on a winning outcome of the secondary game, where the winning outcome does not include all possible outcomes of the secondary game, and that for determining an outcome of the bonus game play. In some embodiments, the outcome of the secondary game can grant the player the ability to select one or more of the virtual dice in the matrix to be re-rolled.

Still further embodiments of the present disclosure include various methods of providing a wager-based game using a computing apparatus. Process steps from these methods can include at least those that correlate to the various portions of computer program code set forth in the foregoing embodiments. Further process steps and details regarding these and other steps may also be included.

Other apparatuses, systems, methods, features and advantages of the disclosure will be or will become apparent to one with skill in the art upon examination of the following figures and detailed description. It is intended that all additional apparatuses, systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed inventive apparatuses, systems and methods for providing video type wager-based games involving dice. These drawings in no way limit any changes in form and detail that may be made to the disclosure by one skilled in the art without departing from the spirit and scope of the disclosure.

DETAILED DESCRIPTION

Figure 1A:
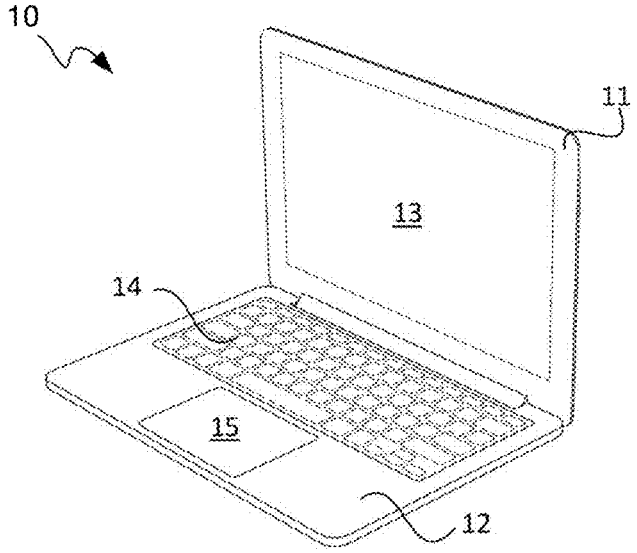
FIG. 1A illustrates in front perspective view an exemplary computing device according to one embodiment of the present disclosure.

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to devices, systems and methods for providing, conducting and facilitating the play of video type wager-based gaming activities on new gaming systems that include the use of dice. Such gaming systems and methods can include at least a primary game having a matrix of dice arranged into multiple rows and multiple columns. Additional features can include a secondary game that includes the use of virtual reels, as well as a bonus game that includes the use of a wheel. Further aspects and features of the various devices, systems, and methods of the present disclosure are set forth in greater detail below.

The disclosed gaming systems and methods may be provided as physical items at a brick and mortar gaming establishment, as well as on one or more computing devices. As such, this disclosure may be applied to any form of presenting gaming activities, whether in person, virtually on a computing device, or otherwise. Although the various examples set forth herein are focused on computerized versions of the disclosed gaming activities, it will be readily understood that such gaming activities can be played in a number of different ways and modes, such as with physical dice, pieces or items, or virtual representations of these items, such that the disclosure is not limited only to computerized embodiments. While it is contemplated that various embodiments of the present disclosure may be provided on one or more individual computerized gaming machines housed in separate gaming machine cabinets, such as those provided in typical casinos and other gaming establishments, it is also contemplated that various embodiments disclosed herein may also be provided on other devices that may receive services over the Internet or any network, such as home computers, laptop computers, personal smart phones, and the like.

Gaming Systems

Referring first to FIG. 1A, an exemplary computing device according to one embodiment of the present disclosure is illustrated in front perspective view. Computing device 10, which can be a laptop computer, can be particularly adapted to provide various wager-based gaming activities to a user, such as blackjack, roulette, craps, pai gow poker, and other such games, including the specific games provided herein. It will be readily appreciated that computing device 10 can be provided in numerous other configurations and formats while still being able to provide the disclosed gaming activities, such that the provided laptop example is for illustrative purposes only. For example, computing device 10 could also be a desktop computer, tablet computer, smart phone, personal digital assistant, or the like.

In general, computing device 10 can include an upper portion 11 and a lower portion 12. Upper portion 11 can include a display component 13 having a display region thereupon, while lower portion 12 can include various input devices, such as a keyboard 14 and touchpad 15. Lower portion 12 may also include a processor (not shown) therein, which can be adapted to generate or process data for a wager-based game, provide display output regarding the wager-based game, and accept user input regarding the wager-based game. Such a processor can be coupled to the display component 13 and the input devices 14, 15, as well as other components of the computing device 10. Such other computing device components or items not shown may also be included, as will be readily appreciated, with such items including, for example, speakers, memories, busses, input ports, disk drives, power supplies, wireless interfaces, and the like.

Figure 1B:
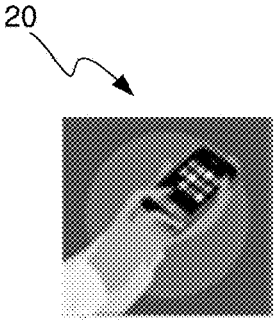
FIG. 1B illustrates in front perspective view an alternative exemplary computing device according to one embodiment of the present disclosure.

FIG. 1B illustrates in front perspective view an alternative exemplary computing device according to one embodiment of the present disclosure. Smart phone 20 can similarly be used to provide or facilitate the play of a wager based game or other similar activity. As in the foregoing computing device 10, smart phone 20 can include at least a processor, display component having a display region, and one or more input devices, such as a touchscreen, button(s) and/or a keypad. In various embodiments, a wager-based game or the like can be provided as an application or "app" on an app store that can be accessed from smart phone 20. Such an app can be downloaded and then played or used on the smart phone 20. Such an app can be specialized for one form of wager-based game, or can be a universal app configured to provide all versions and releases of wager-based games that are available for the provider of a "Crazy Dice" gaming system.

Figure 1C:
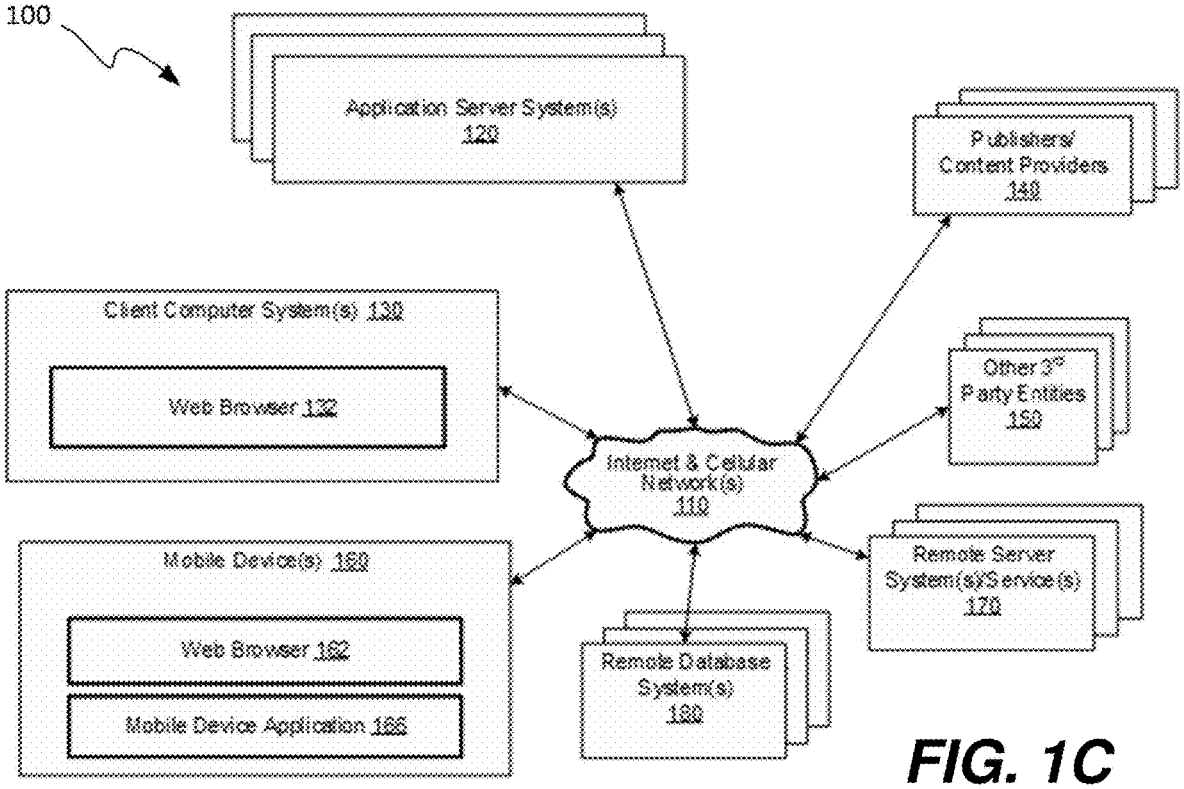
FIG. 1C illustrates in block diagram format an exemplary computerized data network according to one embodiment of the present disclosure.

FIG. 1C illustrates in block diagram format an exemplary computerized data network according to one embodiment of the present disclosure. Computerized data network 100 can be used to implement a "Crazy Dice Gaming System" adapted for the play of wager-based games that involve the use of dice, for example. As described in greater detail herein, different embodiments of Crazy Dice Gaming Systems may be configured, designed, and/or operable to provide various different types of operations, functionalities, and/or features generally relating to wager-based games involving dice. Further, as described in greater detail herein, many of the various operations, functionalities, and/or features of the disclosed Crazy Dice Gaming System may enable or provide different types of advantages and/or benefits to different entities interacting with the Crazy Dice Gaming System.

It is specifically contemplated that various embodiments of the present disclosure may be provided over a traditional casino or gaming establishment system or network. Such a system or network can involve the use of individual computerized gaming machines on a gaming floor, one or more of which are in communication with backend servers, systems, and the like. Various embodiments may also include servers and systems adapted to provide the disclosed games and variations thereof over a network, such as the Internet, so as to provide one or more of the disclosed embodiments to players on home computers, smart phones, and other personal computing devices. It will be understood that the various embodiments and details thereof can be provided over a traditional casino or gaming establishment system or network, over the Internet or other broader network that includes the use of personal computing devices, or both.

According to different embodiments, at least some Crazy Dice Gaming Systems may be configured, designed, and/or operable to provide a number of different advantages and/or benefits and/or may be operable to initiate, and/or enable various different types of operations, functionalities, and/or features, According to different embodiments, at least a portion of the various types of functions, operations, actions, and/or other features provided by the Crazy Dice Gaming System may be implemented at one or more client systems, at one or more server systems, and/or combinations thereof.

According to different embodiments, the Crazy Dice Gaming System may include a plurality of different types of components, devices, modules, processes, systems and the like, which, for example, may be implemented and/or instantiated via the use of hardware and/or combinations of hardware and software. According to various embodiments, the computerized data network 100 adapted for implementation of a Crazy Dice Gaming System may include a plurality of different types of components, devices, modules, processes, systems, etc., which, for example, may be implemented and/or instantiated via the use of hardware and/or combinations of hardware and software. For example, as illustrated in the example embodiment of FIG. 1C, network 100 may include one or more of the following types of systems, components, devices, processes, etc. (or combinations thereof):

- Application Server System(s) 120—In at least one embodiment, the Application Server System(s) may be operable to perform and/or implement various types of functions, operations, actions, and/or other features such as those described or referenced herein.
- Publisher/Content Provider System component(s) 140
- Client Computer System (s) 130
- 3rd Party System(s) 150
- Internet & Cellular Network(s) 110
- Remote Database System(s) 180
- Remote Server System(s)/Service(s) 170, which, for example, may include, but are not limited to, one or more of the following (or combinations thereof):
  - Content provider servers/services
  - Media Streaming servers/services
  - Database storage/access/query servers/services
  - Financial transaction servers/services
  - Payment gateway servers/services
  - Electronic commerce servers/services
  - Event management/scheduling servers/services
- Mobile Device(s) 160—In at least one embodiment, the Mobile Device(s) may be operable to perform and/or implement various types of functions, operations, actions, and/or other features such as those described or referenced herein.

In some embodiments, a decentralized server system may be used for a Crazy Dice Gaming System. Rather than utilizing a centralized server, various system functions can be performed at multiple servers distributed at different locations across a distributed network. As such, while Application Server System(s) 120 can all be on one machine or placed at a single location, Application Server System(s) 120 may also be on multiple machines at multiple locations. For example, one portion of Application Server System(s) 120 relating to new player applications may be located on a first server within one gaming jurisdiction or other location, while another portion of Application Server System(s) 120 relating to the play and resolution of games may be located on a second server located in another gaming jurisdiction or other location. Communications between the different portions of Application Server System(s) 120 may be arranged as appropriate to facilitate functionality between the different system portions.

In at least one embodiment, a Crazy Dice Gaming System may be operable to utilize and/or generate various different types of data and/or other types of information when performing specific tasks and/or operations. This may include, for example, input data/information and/or output data/information. For example, in at least one embodiment, a Crazy Dice Gaming System may be operable to access, process, and/or otherwise utilize information from one or more different types of sources, such as, for example, one or more local and/or remote memories, devices and/or systems. Additionally, in at least one embodiment, a Crazy Dice Gaming System may be operable to generate one or more different types of output data/information, which, for example, may be stored in memory of one or more local and/or remote devices and/or systems. Examples of different types of input data/information and/or output data/information which may be accessed and/or utilized by a Crazy Dice Gaming System may include, but are not limited to, one or more of those described and/or referenced herein.

According to specific embodiments, multiple instances or threads of a Crazy Dice Gaming System may be concurrently implemented and/or initiated via the use of one or more processors and/or other combinations of hardware and/or hardware and software. For example, in at least some embodiments, various aspects, features, and/or functionalities of the Crazy Dice Gaming System may be performed, implemented and/or initiated by one or more of the various systems, components, systems, devices, procedures, processes, etc., described and/or referenced herein.

In at least one embodiment, a given instance of a Crazy Dice Gaming System may access and/or utilize information from one or more associated databases. In at least one embodiment, at least a portion of the database information may be accessed via communication with one or more local and/or remote memory devices. Examples of different types of data which may be accessed by a Crazy Dice Gaming System may include, but are not limited to, one or more of those described and/or referenced herein.

According to different embodiments, various different types of encryption/decryption techniques may be used to facilitate secure communications between devices in a Crazy Dice Gaming System and/or other networks. Examples of the various types of security techniques which may be used may include, but are not limited to, one or more of the following (or combinations thereof): random number generators, SHA-1 (Secured Hashing Algorithm), MD2, MD5, DES (Digital Encryption Standard), 3DES (Triple DES), RC4 (Rivest Cipher), ARC4 (related to RC4), TKIP (Temporal Key Integrity Protocol, uses RC4), AES (Advanced Encryption Standard), RSA, DSA, DH, NTRU, and ECC (elliptic curve cryptography), PKA (Private Key Authentication), Device-Unique Secret Key and other cryptographic key data, SSL, etc. Other security features contemplated may include use of well-known hardware-based and/or software-based security components, and/or any other known or yet to be devised security and/or hardware and encryption/decryption processes implemented in hardware and/or software.

According to different embodiments, one or more different threads or instances of the Crazy Dice Gaming System may be initiated in response to detection of one or more conditions or events satisfying one or more different types of minimum threshold criteria for triggering initiation of at least one instance of the Crazy Dice Gaming System. Various examples of conditions or events which may trigger initiation and/or implementation of one or more different threads or instances of the Crazy Dice Gaming System may include, but are not limited to, one or more of those described and/or referenced herein.

It will be appreciated that the Crazy Dice Gaming System of FIG. 1C is but one example from a wide range of Crazy Dice Gaming System embodiments which may be implemented. Other embodiments of the Crazy Dice Gaming System (not shown) may include additional, fewer and/or different components/features that those illustrated in the exemplary Crazy Dice Gaming System embodiment of FIG. 1C. Generally, the various techniques for implementing a Crazy Dice gaming system or other similar system described herein may be implemented in software, hardware and/or hardware+software. For example, they can be implemented in an operating system kernel, in a separate user process, in a library package bound into network applications, on a specially constructed machine, or on a network interface card. In a specific embodiment, various aspects described herein may be implemented in software such as an operating system or in an application running on an operating system.

Software, hardware and/or software+hardware hybrid embodiments of the Crazy Dice Gaming techniques described herein may be implemented on a general-purpose programmable machine selectively activated or reconfigured by a computer program stored in memory. Such programmable machine may include, for example, mobile or handheld computing systems, PDA, smart phones, notebook computers, tablets, netbooks, desktop computing systems, server systems, cloud computing systems, network devices, etc.

Figure 2:
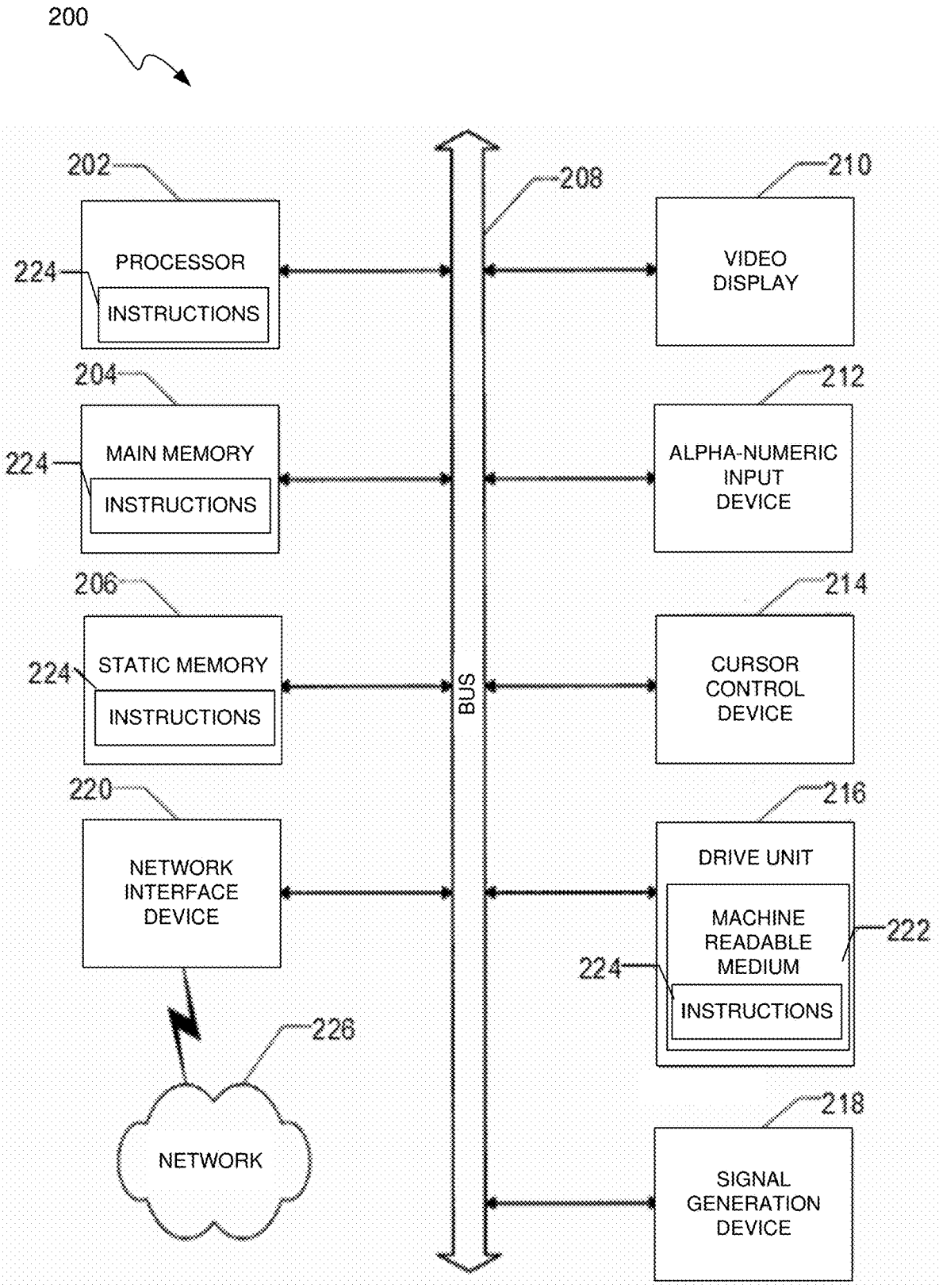
FIG. 2 illustrates a diagram of an exemplary client or end user computing device or system according to one embodiment of the present disclosure.

Turning next to FIG. 2, a diagrammatic representation of an exemplary client or end user computing device or system is provided. Computing device or system 200 can be identical or similar to any of the foregoing computer devices 10, 20, as well as any other suitable computing device or system adapted for providing the disclosed Crazy Dice or other wager-based gaming systems. In some embodiments, it is particularly contemplated that the computing device or system 200 can be a standalone electronic gaming machine ("EGM") suitable for deployment on the floor of a casino or other gaming establishment.

Computing device or system 200 may contain a set of instructions for causing itself or another networked machine to perform any one or more of the methodologies discussed herein. As such, computing device or system 200 may operate as a standalone device or machine, or may be connected (e.g., networked) to other machines. In a networked deployment, the machine may operate in the capacity of a server or a client machine in server-client network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

Exemplary computer device or system 200 includes a processor 202 (e.g., a central processing unit (CPU), a graphics processing unit (GPU) or both), a main memory 204 and a static memory 206, which communicate with each other via a bus 208. The computer device or system 200 may further include a video display unit 210 (e.g., a liquid crystal display (LCD) or a cathode ray tube (CRT)), and also an alphanumeric input device 212 (e.g., a keyboard), a user interface (UI) navigation device 214 (e.g., a mouse), a disk drive unit 216, a signal generation device 218 (e.g., a speaker) and a network interface device 220. The disk drive unit 216 includes a machine-readable medium 222 on which is stored one or more sets of instructions and data structures (e.g., software 224) embodying or utilized by any one or more of the methodologies or functions described herein. The software 224 may also reside, completely or at least partially, within the main memory 204 and/or within the processor 202 during execution thereof by the computer device or system 200, wherein the main memory 204 and/or the processor 202 may also be constituting machine-readable media.

The software 224 may further be transmitted or received over a network 226 via the network interface device 220 utilizing any one of a number of well-known transfer protocols (e. g., HTTP). While the machine-readable medium 222 is shown in an exemplary embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that cause the machine to perform any one or more of the methodologies of the present invention, or that is capable of storing, encoding or carrying data structures utilized by or associated with such a set of instructions. The term "machine-readable medium" shall accordingly be taken to include, but not be limited to, solid-state memories, optical and magnetic media, and carrier wave signals.

According to various embodiments, computing device or system 200 may include a variety of components, modules and/or systems for providing various types of functionality. For example, in at least one embodiment, device or system 200 may include a web browser application which is operable to process, execute, and/or support the use of scripts (e.g., JavaScript, AJAX, etc.), Plug-ins, executable code, virtual machines, HTML5 vector-based web animation (e.g., Adobe Flash), etc. In at least one embodiment, the web browser application may be configured or designed to instantiate components and/or objects at the device or system 200 in response to processing scripts, instructions, and/or other information received from a remote server such as a web server. Examples of such components and/or objects may include, but are not limited to, UI components, database components, processing components, and other components that may facilitate and/or enable device or system 200 to perform and/or initiate various types of operations, activities, functions such as those described herein with respect to providing a Crazy Dice Gaming System or other similar wager based gaming system.

Figure 3:
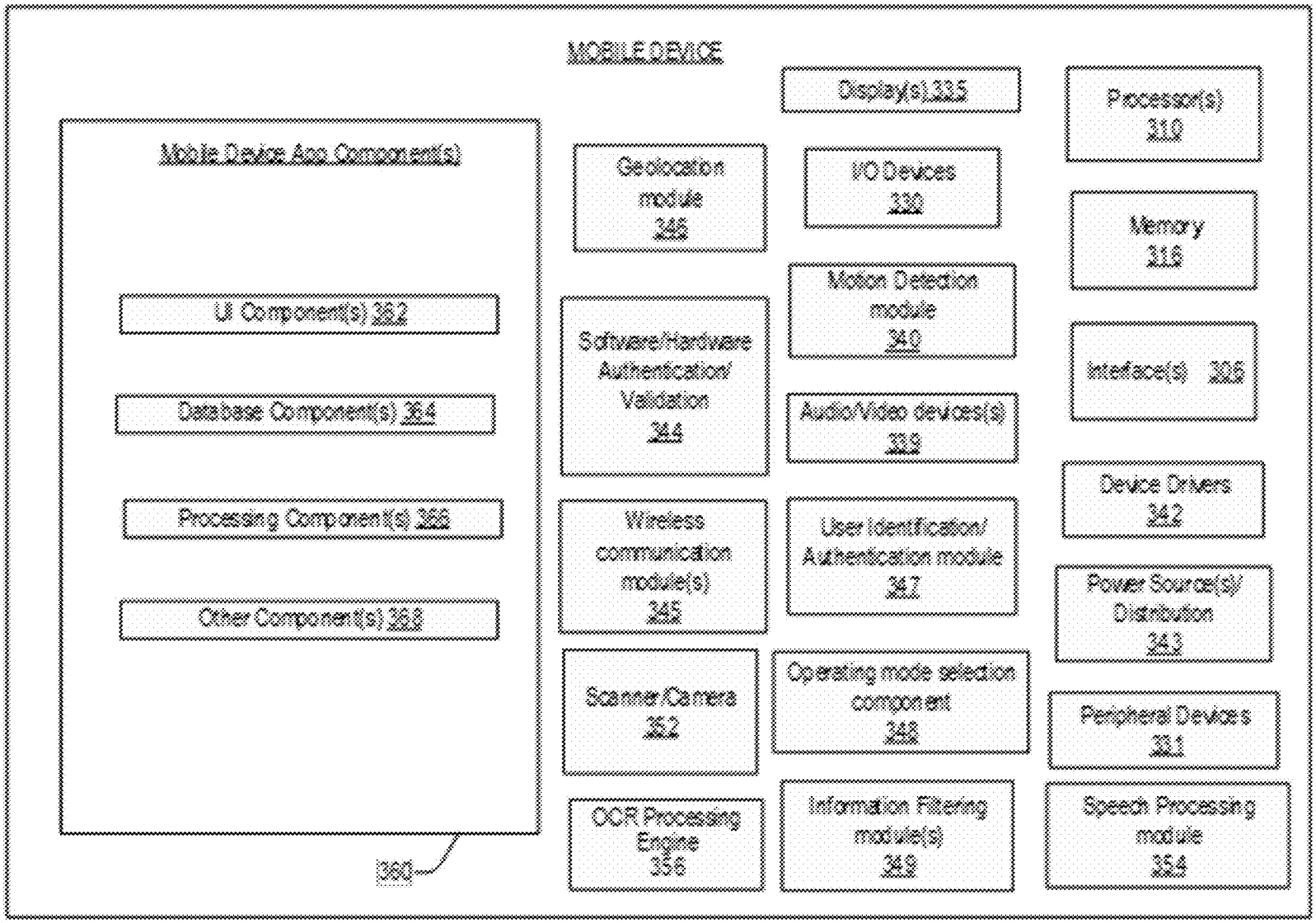
FIG. 3 illustrates in block diagram format an exemplary client system for a mobile device according to one embodiment of the present disclosure.

Continuing with FIG. 3, a block diagram of an exemplary client system for a mobile device is provided. In at least one embodiment, the mobile device client system 300 may include a Crazy Dice Mobile Device App Component, which has been configured or designed to provide functionality for enabling or implementing at least a portion of the various Crazy Dice Gaming System software modules or components at the mobile device client system. Such a mobile device app component can be provided for download by a service provider, such as an app store for smart phone devices. Various aspects, features, and/or functionalities of client system 300 may be performed, implemented and/or initiated by one or more of the following types of systems, components, systems, devices, procedures, processes, and the like. Such items can include, for example: Processor(s) 310, Device Drivers 342, Memory 316, Interface(s) 306, Power Source(s)/Distribution 343, Geolocation module 346, Display(s) 335, I/O Devices 330, Audio/Video devices(s) 339, Peripheral Devices 331, Motion Detection module 340, User Identification/Authentication module 347, Software/Hardware Authentication/Validation 344, Wireless communication module(s) 345, Information Filtering module(s) 349, Operating mode selection component 348, Speech Processing module 354, Scanner/Camera 352, and OCR Processing Engine 356, among other possible components.

As illustrated in the example of FIG. 3, mobile device 300 may include a variety of components, modules and/or systems for providing various functionalities. For example, Mobile Device 300 may include Mobile Device Application components (e.g., 360), which, for example, may include, but are not limited to, one or more of the following (or combinations thereof): UI Components 362, Database Components 364, Processing Components 366, and Other Components 368 which, for example, may include components for facilitating and/or enabling the mobile device to perform and/or initiate various types of operations, activities, functions such as those described herein.

In at least one embodiment, a given instance of the Mobile Device Application component(s) may access and/or utilize information from one or more associated databases. In at least one embodiment, at least a portion of the database information may be accessed via communication with one or more local and/or remote memory devices. Examples of different types of data which may be accessed by the Mobile Device Application component(s) may include, but are not limited to, one or more different types of data, metadata, and/or other information described and/or referenced herein.

According to different embodiments, Mobile Device 300 may further include, but is not limited to, different types of components, modules and/or systems (or combinations thereof) such as, for example, one or more of the following.

At least one processor 310. In at least one embodiment, the processor(s) 310 may include one or more commonly known CPUs that are deployed in many current consumer electronic devices, such as, for example, CPUs or processors from the Motorola or Intel family of microprocessors, etc. In an alternative embodiment, at least one processor may be specially designed hardware for controlling the operations of the client system. In a specific embodiment, a memory (such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software.

Memory 316, which, for example, may include volatile memory (e.g., RAM), non-volatile memory (e.g., disk memory, FLASH memory, EPROMs, etc.), unalterable memory, and/or other types of memory. In at least one implementation, the memory 316 may include functionality similar to at least a portion of functionality implemented by one or more commonly known memory devices such as those described herein and/or generally known to one having ordinary skill in the art. According to different embodiments, one or more memories or memory modules (e.g., memory blocks) may be configured or designed to store data, program instructions for the functional operations of the client system and/or other information relating to the functionality of the various Crazy Dice gaming components described herein. The program instructions may control the operation of an operating system and/or one or more applications, for example. The memory or memories may also be configured to store data structures, metadata, timecode synchronization information, audio/visual media content, asset file information, keyword taxonomy information, advertisement information, and/or information/data relating to other features/functions described herein. Because such information and program instructions may be employed to implement at least a portion of the Crazy Dice gaming components described herein, various aspects described herein may be implemented using machine readable media that include program instructions, state information, etc. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). Examples of program instructions include both machine code, such as produced by a compiler, and files containing higher level code that may be executed by the computer using an interpreter.

Interface(s) 306 which, for example, may include wired interfaces and/or wireless interfaces. In at least one implementation, the interface(s) 306 may include functionality similar to at least a portion of functionality implemented by one or more computer system interfaces such as those described herein and/or generally known to one having ordinary skill in the art. For example, in at least one implementation, the wireless communication interface(s) may be configured or designed to communicate with selected electronic game tables, computer systems, remote servers, other wireless devices (e.g., PDAs, cell phones, player tracking transponders, etc.), etc. Such wireless communication may be implemented using one or more wireless interfaces/protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetics, etc.

Device driver(s) 342. In at least one implementation, the device driver(s) 342 may include functionality similar to at least a portion of functionality implemented by one or more computer system driver devices such as those described herein and/or generally known to one having ordinary skill in the art.

At least one power source (and/or power distribution source) 343. In at least one implementation, the power source may include at least one mobile power source (e.g., battery) for allowing the client system to operate in a wireless and/or mobile environment. For example, in one implementation, the power source 343 may be implemented using a rechargeable, thin-film type battery. Further, in embodiments where it is desirable for the device to be flexible, the power source 343 may be designed to be flexible.

Geolocation module 346 which, for example, may be configured or designed to acquire geolocation information from remote sources and use the acquired geolocation information to determine information relating to a relative and/or absolute position of the client system.

Motion detection component 340 for detecting motion or movement of the client system and/or for detecting motion, movement, gestures and/or other input data from user. In at least one embodiment, the motion detection component 340 may include one or more motion detection sensors such as, for example, MEMS (Micro Electro Mechanical System) accelerometers, that can detect the acceleration and/or other movements of the client system as it is moved by a user.

One or more display(s) 335. According to various embodiments, such display(s) may be implemented using, for example, LCD display technology, OLED display technology, and/or other types of conventional display technology. In at least one implementation, display(s) 335 may be adapted to be flexible or bendable. Additionally, in at least one embodiment the information displayed on display(s) 335 may utilize e-ink technology (such as that available from E Ink Corporation, Cambridge, Mass., www.eink.com), or other suitable technology for reducing the power consumption of information displayed on the display(s) 335.

User Identification/Authentication module 347. In one implementation, the User Identification module may be adapted to determine and/or authenticate the identity of the current user or owner of the client system. For example, in one embodiment, the current user may be required to perform a log in process at the client system in order to access one or more features. Alternatively, the client system may be adapted to automatically determine the identity of the current user based upon one or more external signals such as, for example, an RFID tag or badge worn by the current user that provides a wireless signal to the client system for determining the identity of the current user. In at least one implementation, various security features may be incorporated into the client system to prevent unauthorized users from accessing confidential or sensitive information.

One or more user I/O Device(s) 330 such as, for example, keys, buttons, scroll wheels, cursors, touchscreen sensors, audio command interfaces, magnetic strip reader, optical scanner, etc.

Audio/Video device(s) 339 such as, for example, components for displaying audio/visual media which, for example, may include cameras, speakers, microphones, media presentation components, wireless transmitter/receiver devices for enabling wireless audio and/or visual communication between the client system 300 and remote devices (e.g., radios, telephones, computer systems, etc.). For example, in one implementation, the audio system may include componentry for enabling the client system to function as a cell phone or two-way radio device.

Other types of peripheral devices 331 which may be useful to the users of various client systems, such as, for example: PDA functionality; memory card reader(s); fingerprint reader(s); image projection device(s); social networking peripheral component(s); etc.

Information filtering module(s) 349 which, for example, may be adapted to automatically and dynamically generate, using one or more filter parameters, filtered information to be displayed on one or more displays of the mobile device. In one implementation, such filter parameters may be customizable by the player or user of the device. In some embodiments, information filtering module(s) 349 may also be adapted to display, in real-time, filtered information to the user based upon a variety of criteria such as, for example, geolocation information, contextual activity information, and/or other types of filtering criteria described and/or referenced herein.

Wireless communication module(s) 345. In one implementation, the wireless communication module 345 may be configured or designed to communicate with external devices using one or more wireless interfaces/protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetics, etc.

Software/Hardware Authentication/validation components 344 which, for example, may be used for authenticating and/or validating local hardware and/or software components, hardware/software components residing at a remote device, game play information, wager information, user information and/or identity, etc.

Operating mode selection component 348 which, for example, may be operable to automatically select an appropriate mode of operation based on various parameters and/or upon detection of specific events or conditions such as, for example: the mobile device's current location; identity of current user; user input; system override (e.g., emergency condition detected); proximity to other devices belonging to same group or association; proximity to specific objects, regions, zones, etc. Additionally, the mobile device may be operable to automatically update or switch its current operating mode to the selected mode of operation. The mobile device may also be adapted to automatically modify accessibility of user-accessible features and/or information in response to the updating of its current mode of operation.

Scanner/Camera Component(s) (e.g., 352) which may be configured or designed for use in scanning identifiers and/or other content from other devices and/or objects such as for example: mobile device displays, computer displays, static displays (e.g., printed on tangible mediums), etc.

OCR Processing Engine (e.g., 356) which, for example, may be operable to perform image processing and optical character recognition of images such as those captured by a mobile device camera, for example.

Speech Processing module (e.g., 354) which, for example, may be operable to perform speech recognition, and may be operable to perform speech-to-text conversion.

Figure 4:
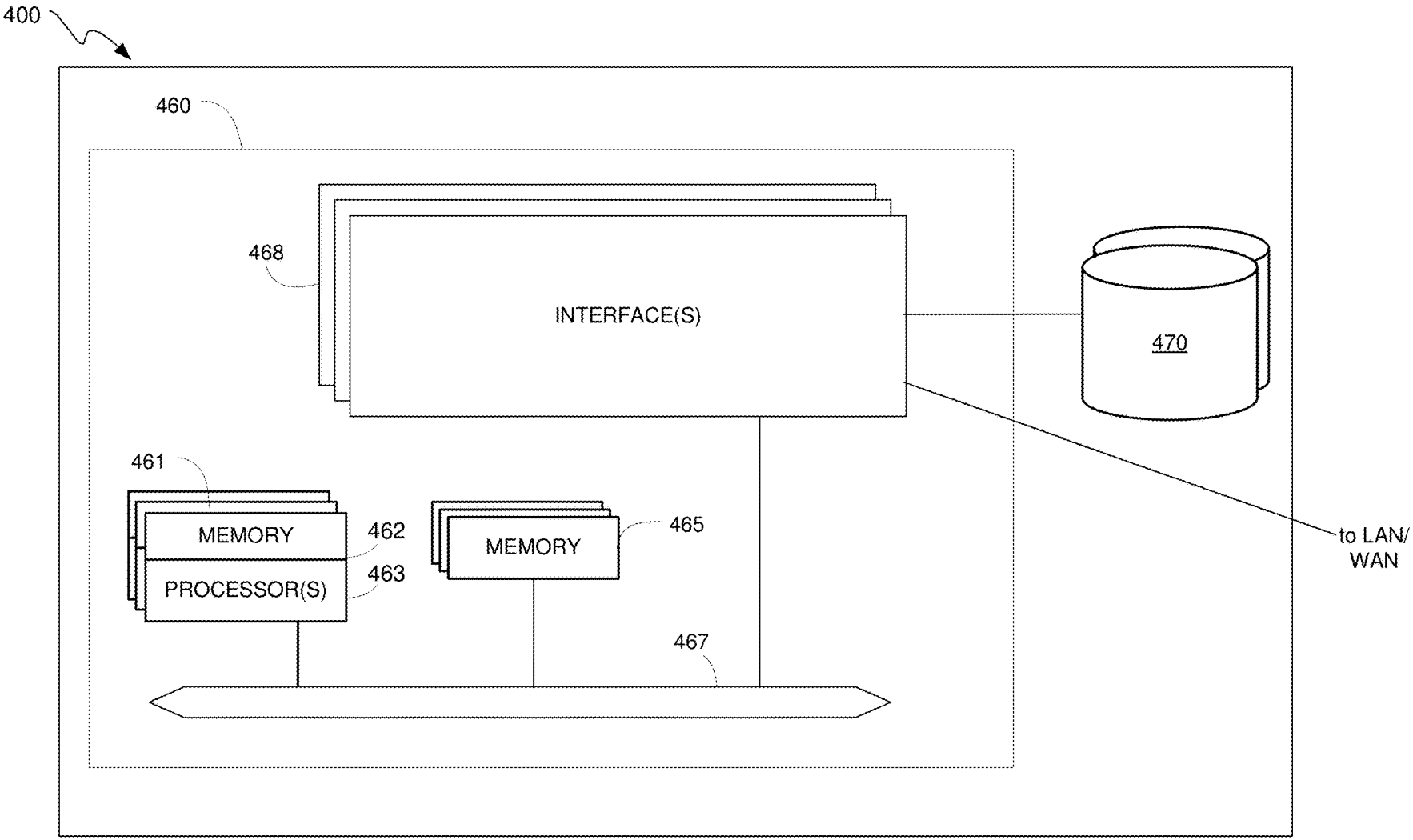
FIG. 4 illustrates in block diagram format an exemplary server system according to one embodiment of the present disclosure.

FIG. 4 illustrates in block diagram format an exemplary server system 400, which may be used for implementing various aspects/features described herein. In at least one embodiment, the server system 400 includes at least one network device 460, and at least one storage device 470 (such as, for example, a direct attached storage device). In one embodiment, server system 400 may be suitable for implementing at least some of the Crazy Dice gaming techniques described herein.

According to one embodiment, network device 460 may include a master central processing unit (CPU) 462, interfaces 468, and a bus 467 (e.g., a PCI bus). When acting under the control of appropriate software or firmware, the CPU 462 may be responsible for implementing specific functions associated with the functions of a desired network device. For example, when configured as a server, the CPU 462 may be responsible for analyzing packets; encapsulating packets; forwarding packets to appropriate network devices; instantiating various types of virtual machines, virtual interfaces, virtual storage volumes, virtual appliances; etc. The CPU 462 preferably accomplishes at least a portion of these functions under the control of software including an operating system (e.g. Linux), and any appropriate system software (such as, for example, AppLogic™ software).

CPU 462 may include one or more processors 463 such as, for example, one or more processors from the AMD, Motorola, Intel and/or MIPS families of microprocessors. In an alternative embodiment, processor 463 may be specially designed hardware for controlling the operations of server system 400. In a specific embodiment, a memory 461 (such as non-volatile RAM and/or ROM) also forms part of CPU 462. However, there may be many different ways in which memory could be coupled to the system. Memory block 461 may be used for a variety of purposes such as, for example, caching and/or storing data, programming instructions, etc.

The interfaces 468 may be typically provided as interface cards (sometimes referred to as "line cards"). Alternatively, one or more of the interfaces 468 may be provided as on-board interface controllers built into the system motherboard. Generally, they control the sending and receiving of data packets over the network and sometimes support other peripherals used with the server system 400. Among the interfaces that may be provided may be FC interfaces, Ethernet interfaces, frame relay interfaces, cable interfaces, DSL interfaces, token ring interfaces, Infiniband interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like. Other interfaces may include one or more wireless interfaces such as, for example, 802.11 (WiFi) interfaces, 802.15 interfaces (including Bluetooth™), 802.16 (WiMax) interfaces, 802.22 interfaces, Cellular standards such as CDMA interfaces, CDMA2000 interfaces, WCDMA interfaces, TDMA interfaces, Cellular 3G interfaces, etc.

Generally, one or more interfaces may include ports appropriate for communication with the appropriate media. In some cases, they may also include an independent processor and, in some instances, volatile RAM. The independent processors may control such communications intensive tasks as packet switching, media control and management. By providing separate processors for the communications intensive tasks, these interfaces allow the master microprocessor 462 to efficiently perform routing computations, network diagnostics, security functions, etc.

In at least one embodiment, some interfaces may be configured or designed to allow the server system 400 to communicate with other network devices associated with various local area network (LANs) and/or wide area networks (WANs). Other interfaces may be configured or designed to allow network device 460 to communicate with one or more direct attached storage device(s) 470.

Although the system shown in FIG. 4 illustrates one specific network device described herein, it is by no means the only network device architecture on which one or more embodiments can be implemented. For example, an architecture having a single processor that handles communications as well as routing computations, etc. may be used. Further, other types of interfaces and media could also be used with the network device.

Regardless of network device configuration, a network may employ one or more memories or memory modules (such as, for example, memory block 465, which, for example, may include random access memory (RAM)) configured to store data, program instructions for the general-purpose network operations and/or other information relating to the functionality of the various Crazy Dice gaming techniques described herein. The program instructions may control the operation of an operating system and/or one or more applications, for example. The memory or memories may also be configured to store data structures, and/or other specific non-program information described herein.

Because such information and program instructions may be employed to implement the systems/methods described herein, one or more embodiments relates to machine readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that may be specially configured to store and perform program instructions, such as read-only memory devices (ROM) and random access memory (RAM). Some embodiments may also be embodied in transmission media such as, for example, a carrier wave travelling over an appropriate medium such as airwaves, optical lines, electric lines, etc. Examples of program instructions include both machine code, such as produced by a compiler, and files containing higher level code that may be executed by the computer using an interpreter.

Figure 5:
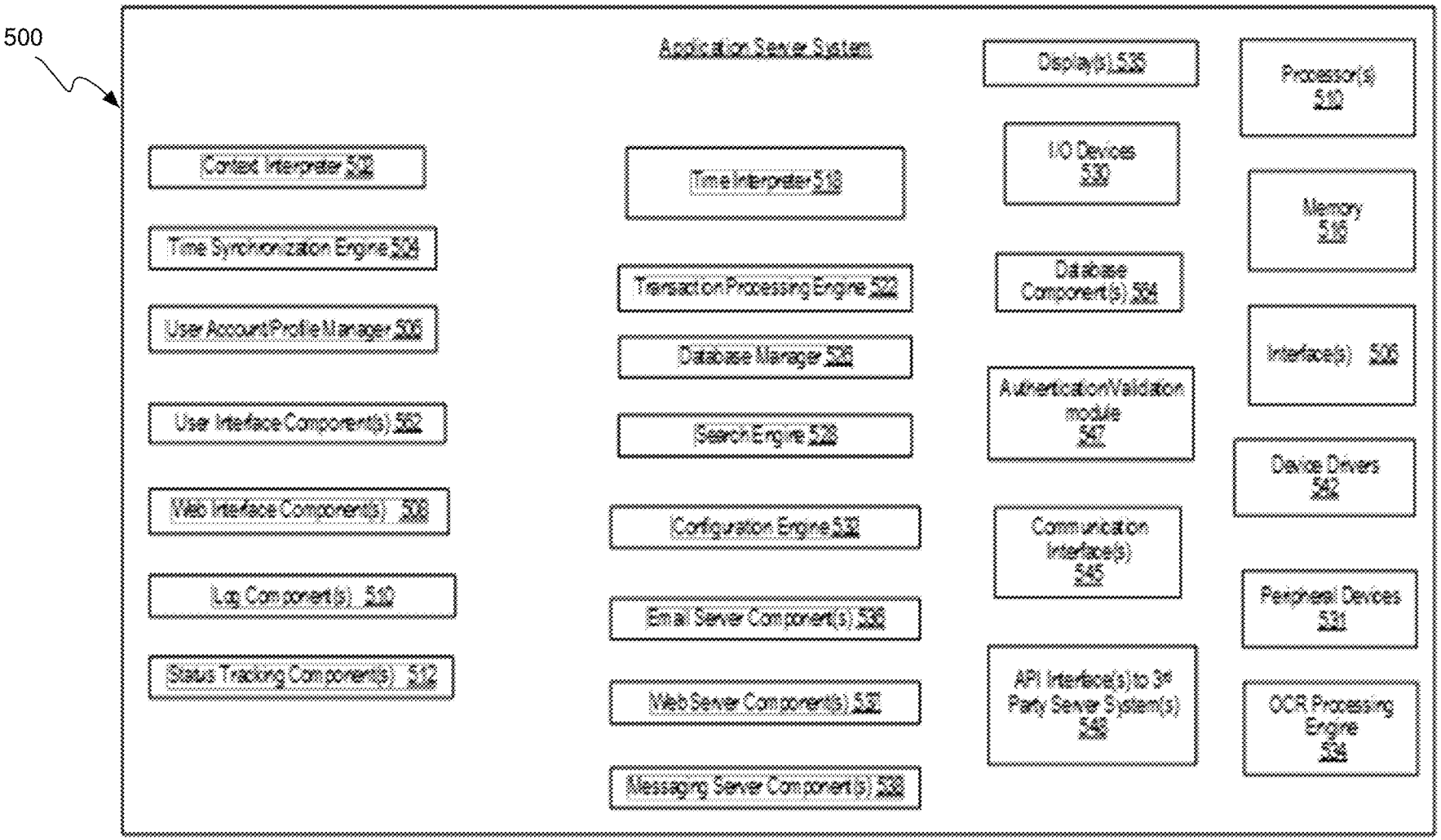
FIG. 5 illustrates in block diagram format an exemplary application server system according to one embodiment of the present disclosure.

FIG. 5 provides a block diagram of an application server system. Application server system 500 may be operable to perform and/or implement various types of functions, operations, actions, and/or other features associated with providing a Crazy Dice game or application. In at least one embodiment, application server system 500 may include a plurality of components operable to perform and/or implement various types of functions, operations, actions, and/or other features such as, for example:

- Context Interpreter (e.g., 502) which, for example, may be operable to automatically and/or dynamically analyze contextual criteria relating to a detected set of event(s) and/or condition(s), and automatically determine or identify one or more contextually appropriate response(s) based on the contextual interpretation of the detected event(s)/condition(s). According to different embodiments, examples of contextual criteria which may be analyzed may include, but are not limited to, one or more of the following (or combinations thereof):
  - location-based criteria (e.g., geolocation of client device, geolocation of agent device, etc.)
  - time-based criteria
  - identity of user(s)
  - user profile information
  - transaction history information
  - recent user activities
  - proximate business-related criteria (e.g., criteria which may be used to determine whether the client device is currently located at or near a recognized business establishment such as a bank, gas station, restaurant, supermarket, etc.)
- Time Synchronization Engine (e.g., 504) which, for example, may be operable to manages universal time synchronization (e.g., via NTP and/or GPS)
- Search Engine (e.g., 528) which, for example, may be operable to search for transactions, logs, items, accounts, options in the Crazy Dice databases
- Configuration Engine (e.g., 532) which, for example, may be operable to determine and handle configuration of various customized configuration parameters for one or more devices, component(s), system(s), process(es), etc.
- Time Interpreter (e.g., 518) which, for example, may be operable to automatically and/or dynamically modify or change identifier activation and expiration time(s) based on various criteria such as, for example, time, location, transaction status, etc.

Authentication/Validation Component(s) (e.g., 547) (password, software/hardware info, SSL certificates) which, for example, may be operable to perform various types of authentication/validation tasks such as, for example, one or more of the following (or combinations thereof):

verifying/authenticating devices, verifying passwords, passcodes, SSL certificates, biometric identification information, and/or other types of security-related information verify/validate activation and/or expiration times In one implementation, the Authentication/Validation Component(s) may be adapted to determine and/or authenticate the identity of the current user or owner of the mobile client system. For example, in one embodiment, the current user may be required to perform a log in process at the mobile client system in order to access one or more features. In some embodiments, the mobile client system may include biometric security components which may be operable to validate and/or authenticate the identity of a user by reading or scanning the user's biometric information (e.g., fingerprints, face, voice, eye/iris, etc.). In at least one implementation, various security features may be incorporated into the mobile client system to prevent unauthorized users from accessing confidential or sensitive information.

Transaction Processing Engine (e.g., 522) which, for example, may be operable to handle various types of transaction processing tasks such as, for example, one or more of the following (or combinations thereof):

identifying/determining transaction type determining which payment gateway(s) to use associating databases information to identifiers etc.

Database Manager (e.g., 526) which, for example, may be operable to handle various types of tasks relating to database updating, database management, database access, etc. In at least one embodiment, the Database Manager may be operable to manage TISS databases, Crazy Dice Device Application databases, etc.

Log Component(s) (e.g., 510) which, for example, may be operable to generate and manage transactions history logs, system errors, connections from APIs, etc.

Status Tracking Component(s) (e.g., 512) which, for example, may be operable to automatically and/or dynamically determine, assign, and/or report updated transaction status information based, for example, on the state of the transaction. In at least one embodiment, the status of a given transaction may be reported as one or more of the following (or combinations thereof): Completed, Incomplete, Pending, Invalid, Error, Declined, Accepted, etc.

Gateway Component(s) (e.g., 514) which, for example, may be operable to facilitate and manage communications and transactions with external Payment Gateways.

Web Interface Component(s) (e.g., 508) which, for example, may be operable to facilitate and manage communications and transactions with Crazy Dice web portal(s).

API Interface(s) to Application Server System(s) (e.g., 546) which, for example, may be operable to facilitate and manage communications and transactions with API Interface(s) to Application Server System(s)

API Interface(s) to 3rd Party Server System(s) (e.g., 548) which, for example, may be operable to facilitate and manage communications and transactions with API Interface(s) to 3rd Party Server System(s)

OCR Processing Engine (e.g., 534) which, for example, may be operable to perform image processing and optical character recognition of images such as those captured by a mobile device camera, for example.

At least one processor 510. In at least one embodiment, the processor(s) 510 may include one or more commonly known CPUs which are deployed in many of today's consumer electronic devices, such as, for example, CPUs or processors from the Motorola or Intel family of microprocessors, etc. In an alternative embodiment, at least one processor may be specially designed hardware for controlling the operations of the mobile client system. In a specific embodiment, a memory (such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software.

Memory 516, which, for example, may include volatile memory (e.g., RAM), non-volatile memory (e.g., disk memory, FLASH memory, EPROMs, etc.), unalterable memory, and/or other types of memory. In at least one implementation, the memory 516 may include functionality similar to at least a portion of functionality implemented by one or more commonly known memory devices such as those described herein and/or generally known to one having ordinary skill in the art. According to different embodiments, one or more memories or memory modules (e.g., memory blocks) may be configured or designed to store data, program instructions for the functional operations of the mobile client system and/or other information relating to the functionality of the various Mobile Transaction techniques described herein. The program instructions may control the operation of an operating system and/or one or more applications, for example. The memory or memories may also be configured to store data structures, metadata, identifier information/images, and/or information/data relating to other features/functions described herein. Because such information and program instructions may be employed to implement at least a portion of the Crazy Dice Gaming System techniques described herein, various aspects described herein may be implemented using machine readable media that include program instructions, state information, etc. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). Examples of program instructions include both machine code, such as produced by a compiler, and files containing higher level code that may be executed by the computer using an interpreter.

Interface(s) 506 which, for example, may include wired interfaces and/or wireless interfaces. In at least one implementation, the interface(s) 506 may include functionality similar to at least a portion of functionality implemented by one or more computer system interfaces such as those described herein and/or generally known to one having ordinary skill in the art.

Device driver(s) 542. In at least one implementation, the device driver(s) 542 may include functionality similar to at least a portion of functionality implemented by one or more computer system driver devices such as those described herein and/or generally known to one having ordinary skill in the art.

One or more display(s) 535. According to various embodiments, such display(s) may be implemented using, for example, LCD display technology, OLED display technology, and/or other types of conventional display technology. In at least one implementation, display(s) 535 may be adapted to be flexible or bendable. Additionally, in at least one embodiment the information displayed on display(s) 535 may utilize e-ink technology (such as that available from E Ink Corporation, Cambridge, Mass., www.eink.com), or other suitable technology for reducing the power consumption of information displayed on the display(s) 535.

Email Server Component(s) 536, which, for example, may be configured or designed to provide various functions and operations relating to email activities and communications.

Web Server Component(s) 537, which, for example, may be configured or designed to provide various functions and operations relating to web server activities and communications.

Messaging Server Component(s) 538, which, for example, may be configured or designed to provide various functions and operations relating to text messaging and/or other social network messaging activities and/or communications.

Full Game Overview

As noted above, various embodiments of the present disclosure generally relate to video type wager-based games, and more specifically to those that utilize multiple dice in game play to create multiple winning opportunities for player. In various embodiments, such games can include multiple portions, such as a primary game, a secondary game, a bonus game, and the like. Some versions of the provided games can include each of primary, secondary, and bonus games, while others may include just one or two of such games. Further game portions may also be added as desired. In various embodiments, at least one of the provided game portions can involve dice. For example, the primary game can involve dice arranged into a matrix.

Figure 6:
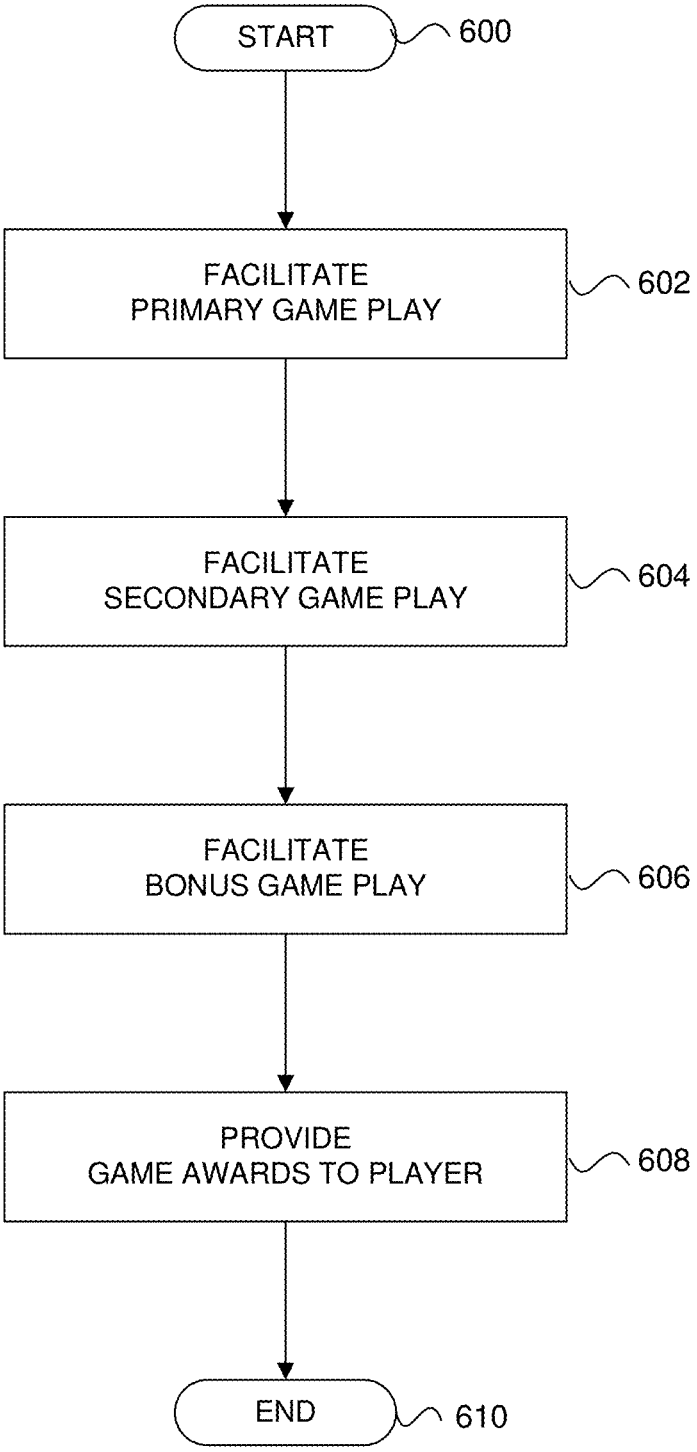
FIG. 6 illustrates a flowchart of an exemplary overview method of providing a video type wager-based game having a primary game, a secondary game, and a bonus game according to one embodiment of the present disclosure.

Turning now to FIG. 6, a flowchart of an exemplary overview method of providing a video type wager-based game having a primary game, a secondary game, and a bonus game is provided. It will be readily appreciated that the illustrated method provides a basic overview, and that further details and steps may be added, as set forth below. After a start step 600, a process step 602 can involve facilitating the play of a primary game. As set forth in greater detail below, the primary game can involve the use of virtual dice arranged in a matrix having multiple rows and multiple columns, and each of the virtual dice can be positioned in exactly one row and exactly one column. The play of the primary game can include a random determination of the virtual dice.

The following process step 604 can involve facilitating the play of a secondary game. As set forth below, the secondary game can involve the use of virtual reels. The secondary game can also be interactive with the primary game in some embodiments. The play of the secondary game can include a random determination of the virtual reels. A subsequent process step 606 can involve facilitating the play of a bonus game. As set forth below, the bonus game can involve the use of a virtual wheel. The bonus game can be conditional based upon the outcome of the secondary game, the primary game, or both. The play of the bonus game can include a random determination of the virtual wheel. At the next process step 608, game awards can be provided to the player based upon the outcomes of the primary game, secondary game, and/or bonus game, as may be appropriate. The method then ends at end step 610.

For the foregoing flowchart, it will be readily appreciated that not every method step provided is always necessary, and that further steps not set forth herein may also be included. For example, added steps can involve accepting player input, allowing a player to change settings, and/or determining game outcomes. Furthermore, the exact order of steps may be altered as desired, and some steps may be performed simultaneously. For example, steps 602 and 604 can be performed simultaneously in various embodiments. Not all steps are always necessary either. For example, step 606 may not be performed in all embodiments. While the provided examples are with respect to computerized wager-based games, it will be readily appreciated that the provided methods can also be used with respect to physical wager-based games, as well as other alternative embodiments.

Figure 7:
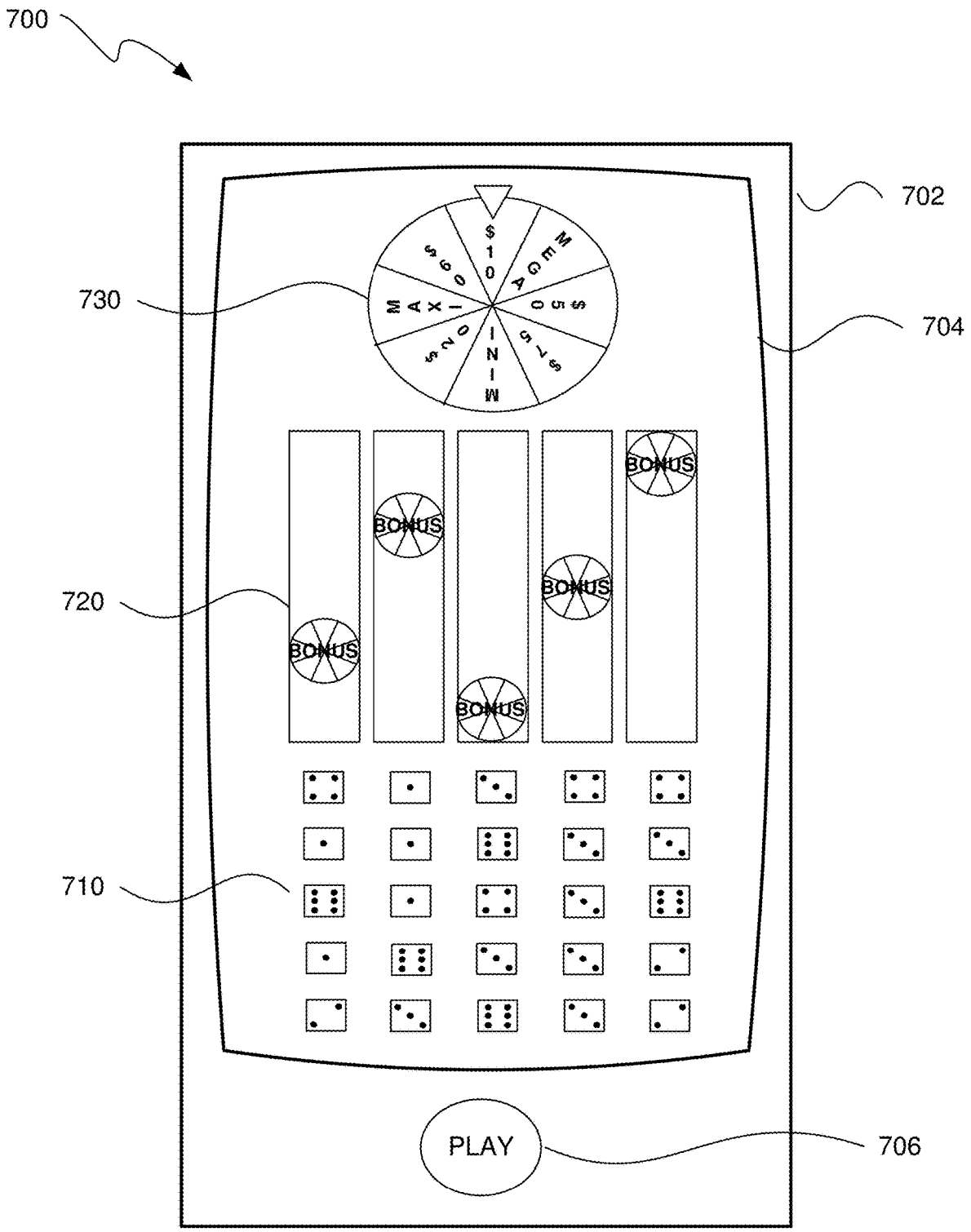
FIG. 7 illustrates a screen shot of an exemplary video type wager-based game having a primary game, a secondary game, and a bonus game according to one embodiment of the present disclosure.

Continuing with FIG. 7, a screen shot of an exemplary video type wager-based game having a primary game, a secondary game, and a bonus game is illustrated. Gaming system 700 can generally include a gaming machine 702 having a display screen 704 and one or more input devices, such as play button 706. It will be appreciated that gaming machine 702 can represent any type of gaming machine, such as a stand-alone electronic gaming machine suitable for deployment on a casino floor, as well as a personal computer, laptop, mobile device, and the like. It will also be understood that the display shown on display screen 704 is simplified for purposes of illustration, and that further items not shown may also be present, such as instructions, credits, advertisements, and the like. Further, additional input and/or output components not shown may also be present, such as additional buttons, levers, handles, touchscreens, speakers, money or credit acceptors, ticket printers, and the like, as will be understood by those skilled in the art.

Display screen 704 can depict various items for an overall game. These can include, for example, a primary game 710, a secondary game 720, and a bonus game 730, among other possible game portions and items. As shown, primary game 710 can include a plurality of virtual dice arranged in a matrix, secondary game 720 can include a plurality of virtual reels, and bonus game 730 can include a virtual wheel. Various embodiments can include each of primary game 710, secondary game 720, and bonus game 730 as shown, while some embodiments may include only one or two of such games. In some arrangements, one or more of these game portions may be shown but not used in the play of a particular game. For example, a player may elect not to use the secondary game, the bonus game, or both for a particular game play.

Primary Game

In various embodiments, a primary game can involve the use of virtual dice arranged into a matrix. Referencing FIG. 8, a flowchart of one exemplary method of providing a video type wager-based game involving virtual dice is provided. It will be readily appreciated that the illustrated method provides a basic overview, and that further details and steps may be added, as set forth below. After a start step 800, a process step 802 involves providing to a player a video-based wagering game including a primary game. The primary game can include virtual dice arranged in a matrix having multiple rows and multiple columns, and each of the virtual dice can be positioned in exactly one row and exactly one column. In various embodiments, the virtual dice used can be standard six-sided dice. Other embodiments may utilize dice having more or fewer sides.

At a following process step 804, an input can be accepted from the player regarding play of the primary game, after which play of the primary game can be facilitated at the next process step 806. The play of the primary game can include a random determination of the virtual dice. The virtual dice can be arranged in a matrix, such as a 5×5 matrix having 25 dice, as detailed below. At subsequent process step 808, an outcome of the primary game can be determined, and this outcome can be based upon the random determination of the virtual dice. The method then ends at end step 810.

For the foregoing flowchart, it will be readily appreciated that not every method step provided is always necessary, and that further steps not set forth herein may also be included. For example, added steps can involve providing an award to the player, allowing a user to change settings, and/or providing a secondary or bonus game. Furthermore, the exact order of steps may be altered as desired, and some steps may be performed simultaneously. For example, steps 806 and 808 can be considered as being performed simultaneously in various embodiments. Not all steps are always necessary either. For example, step 804 may not be performed in all embodiments. Also, while the provided examples are with respect to computerized wager-based games, it will be readily appreciated that the provided methods can also be used with respect to physical wager-based games, as well as other alternative embodiments.

Figure 8:
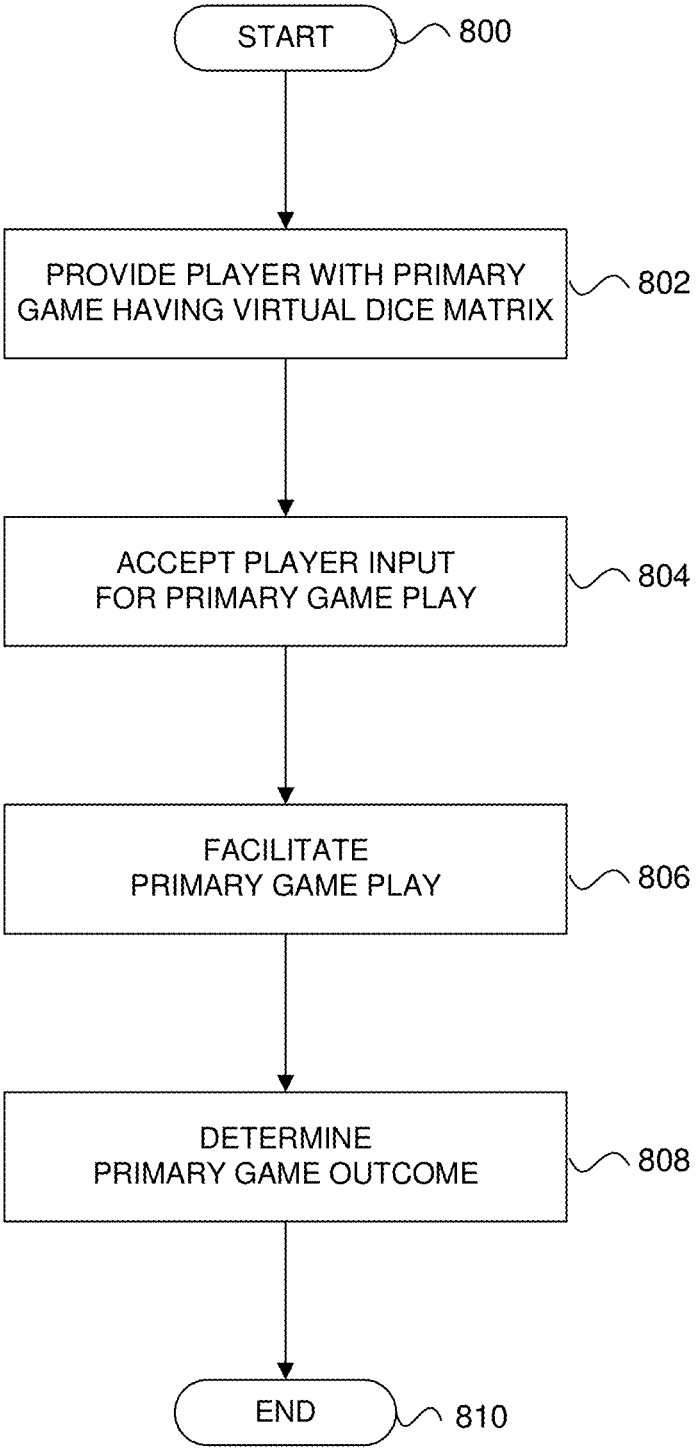
FIG. 8 illustrates a flowchart of an exemplary basic method of providing a video type wager-based game involving dice according to one embodiment of the present disclosure.

It will be appreciated that the steps set forth in FIG. 8 may refer to a primary game, and that other games may also be included, such as a secondary game, a bonus game, and others. As noted, the primary game may involve the use of dice arranged into a matrix having multiple rows and multiple columns. Specific and non-limiting examples of the primary game will now be provided. In one specific embodiment of the primary game, a player may wager on the outcomes of a first 5×5 matrix of 25 dice. While other matrix sizes are also possible (e.g., 6×6, 7×7, etc.), the specific example set forth herein shall focus on a 5×5 matrix.

Figure 9:
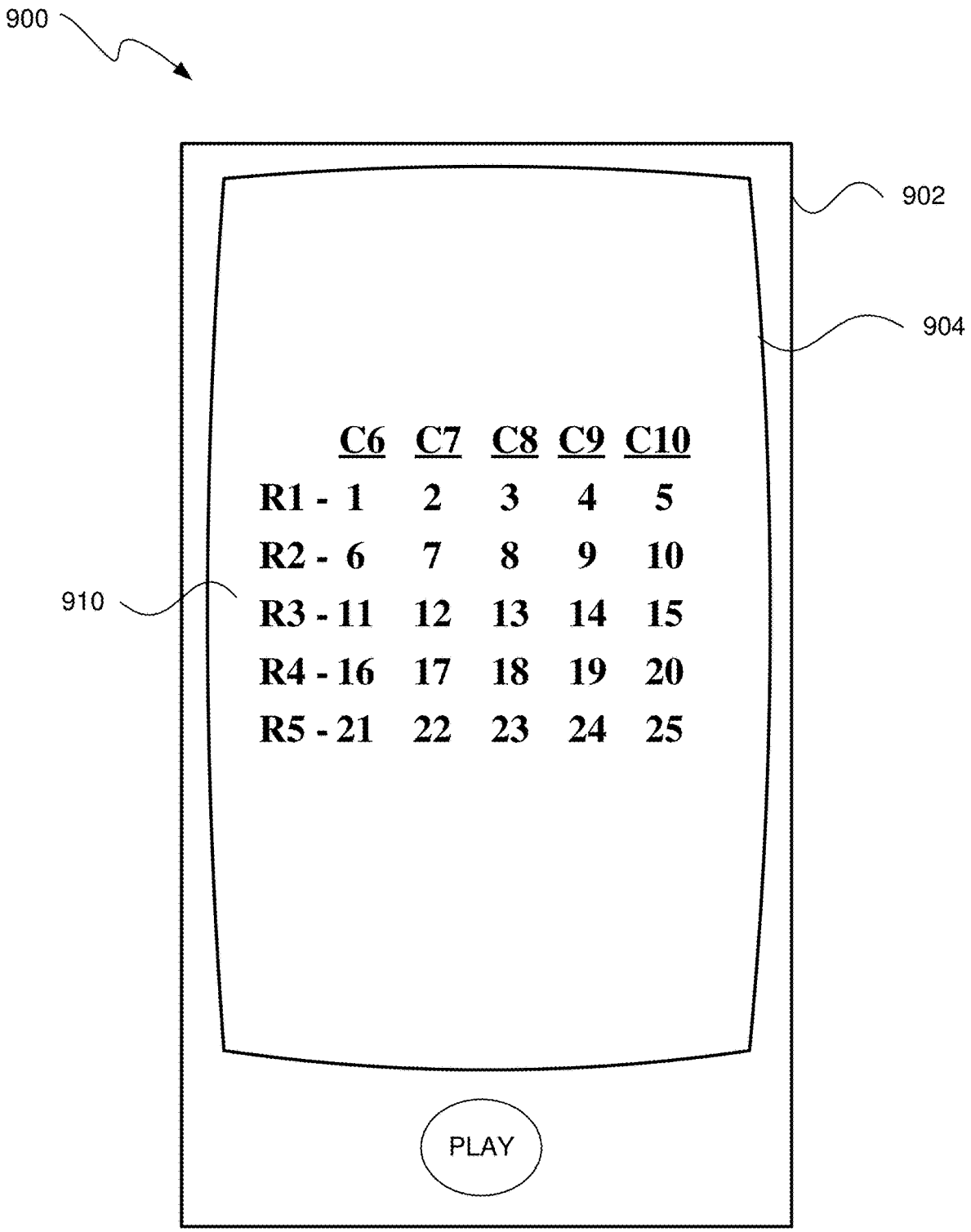
FIG. 9 illustrates a graphical representation of exemplary matrix positions for a wager-based game involving dice according to one embodiment of the present disclosure.

FIG. 9 illustrates a graphical representation of exemplary matrix positions for a wager-based game involving dice. Gaming system 900 can include a gaming machine 902 having a screen, such as that which is shown for gaming system 700 above. A graphical representation of a matrix 910 depicts the positions for 25 dice arranged into a 5×5 matrix. As shown, there can be five rows (R1-R5) and five columns (C6-C10), with each row and column having five dice positions. Each die can be located in one row and one column. For example, die 14 is located in row R3 and column C9. Similar arrangements can apply for different matrix sizes, as will be readily appreciated.

In various embodiments, a player can be allowed to place wagers on each of the rows and each of the columns (e.g., paylines) in the dice matrix. In the case of a 5×5 matrix, this can result in a wager on each of the 5 rows and each of the 5 columns, for a total of 10 wagers. Additional wagers may also be possible, such as "scatter" wagers, where a scatter wager can be across all dice in the matrix. For example, a scatter wager may involve the total number of aces (e.g., "1s") across all 25 dice in a 5×5 dice matrix. In some arrangements, this can result in the placement of 10 wagers for each of the rows of columns. An additional scatter wager can result in 11 wagers for the play of a single game involving a 5×5 dice matrix. A player can be allowed to bet a number of credits for each separate wager. This can be the same number of credits for each wager, or this amount can be varied for each separate wager. For example, a player may elect to bet five credits for each of 11 different wagers (5 rows, 5 columns, 1 scatter). As another example, a player may elect to bet one credit for each of the rows R1-R5 (5 bets), five credits for each of the columns C6-C10 (5 more bets), and ten credits as a further scatter bet. Options may exist to allow a player to bet a different number of credits for each different wager, if desired. In some variations, a player may elect to wager nothing on one or more of the rows, columns, and/or scatter, such as where a player may decide that he or she has an unlucky row.

Figure 10A:
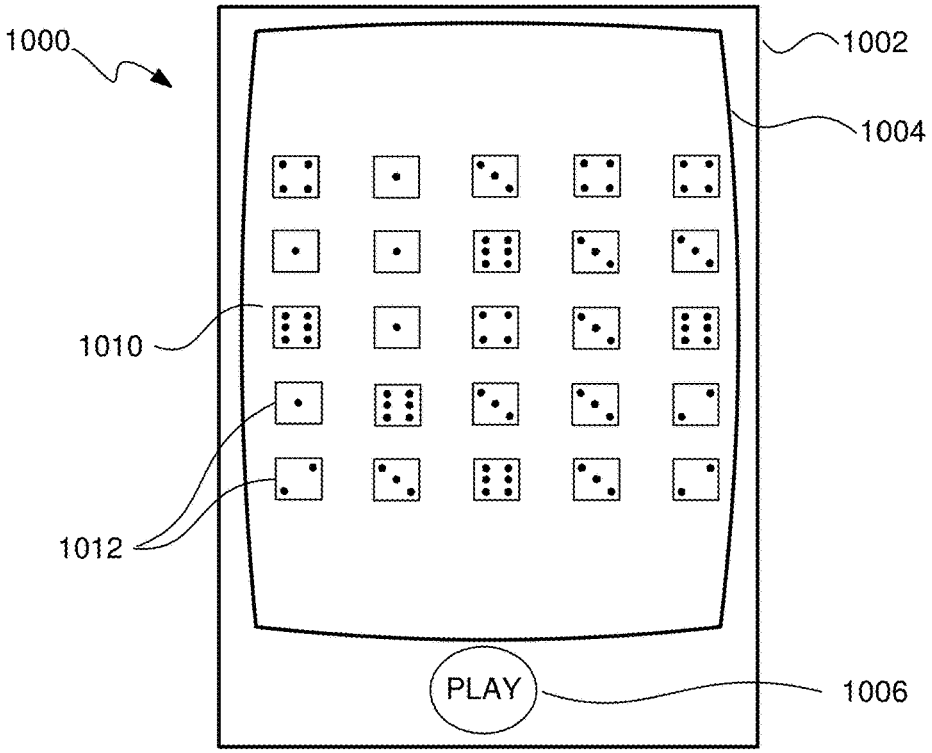
FIG. 10A illustrates a screen shot of an exemplary video type wager-based game involving a primary game having dice prior to the play of a game according to one embodiment of the present disclosure.
Figure 10B:
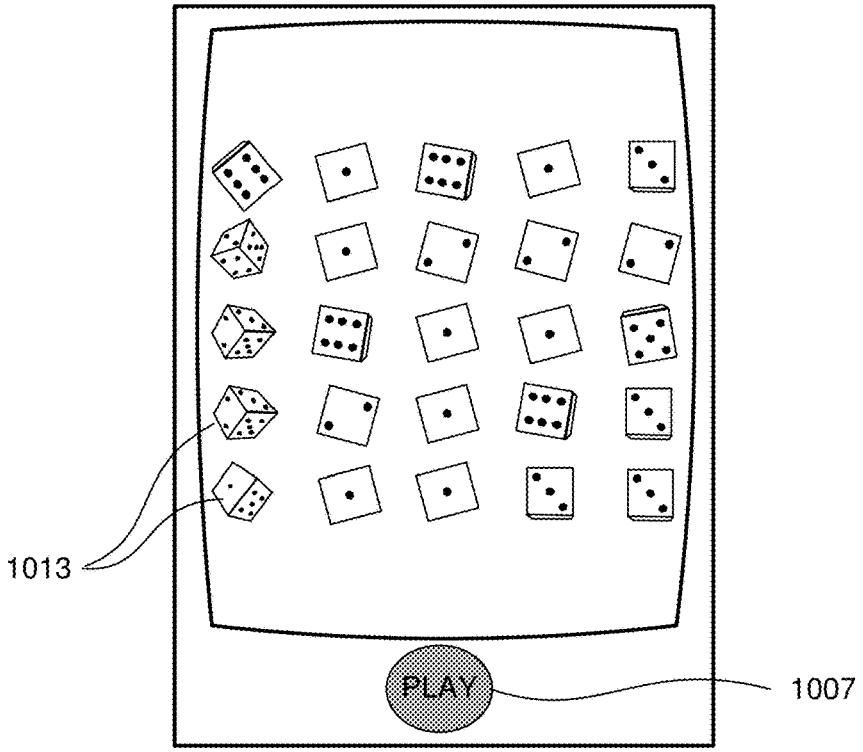
FIG. 10B illustrates a screen shot of an exemplary video type wager-based game involving a primary game having dice during the play of a game according to one embodiment of the present disclosure.

After the player places all of the desired wagers, the player can then provide an input that initiates game play for the primary game. In various embodiments, initiating game play can cause all of the virtual dice in the matrix to be randomly "rolled" or spun to create an outcome for the primary game. This can be graphically represented on the game display in a variety of possible ways. Moving next to FIGS. 10A and 10B, screen shots of an exemplary video type wager-based game involving a primary game having a 5×5 matrix of dice are provided. FIG. 10A depicts a dice matrix prior to the play of a primary game, while FIG. 10B depicts a dice matrix during the play of the primary game.

Similar to the foregoing embodiments, gaming system 1000 can include a gaming machine 1002 having a display screen 1004 and a play button input 1006. On the display screen 1004, a primary game 1010 can include multiple dice 1012 arranged into a 5×5 matrix. Again, the dice can be standard six-sided dice, although other types of dice may also be used if desired. As shown in FIG. 10A, the dice 1012 can be arranged prior to the play of a game. After a player presses the play button input 1006 to initiate a game play, the dice can begin to roll or rotate. As shown in FIG. 10B, the play button input 1007 has been actuated, and the dice 1013 in the matrix are all rolling. It will be ready appreciated that such rolling can be graphically animated until the dice all stop at a final result for each die. Such a final result for the dice can be randomly determined in software in any of a number of suitable ways, as will be understood by those of skill in the art.

Figure 11:
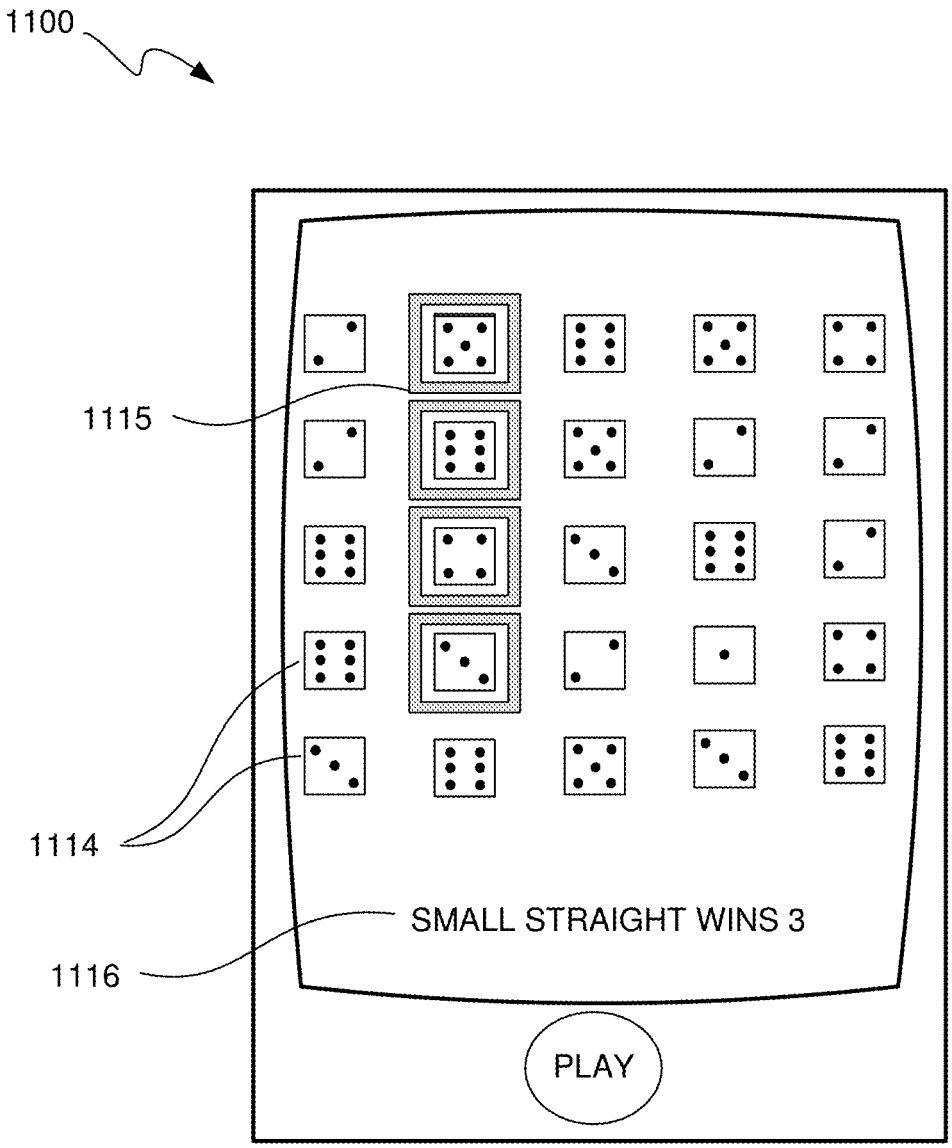
FIG. 11 illustrates a screen shot of the exemplary video type wager-based game after the play of a game according to one embodiment of the present disclosure.

FIG. 11 illustrates a screen shot of an exemplary video type wager-based game after the play of a game. Gaming system 1100 includes a display of a 5×5 matrix of dice 1114 after the conclusion of a game play. As shown, the dice 1114 are no longer rolling or rotating, and one or more winning combinations can be displayed and highlighted. In the exemplary illustration of FIG. 11, one column (e.g., C7) has a winning combination of a small straight. This can be highlighted by having graphical outlines or boxes 1115 drawn around each of the dice in the winning combination. Further, a text graphic 1116 can declare the winning combination and amount won, such as, for example, "Small Straight wins 3." In the event that there are multiple winning combinations, these can all be listed together in some embodiments. Alternatively, each winning combination can be displayed by the text graphic 1116 for several seconds before being removed in favor of the next winning combination appearing in the text graphic 1116. Appropriate different highlight boxes 1115 can then appear around the dice for that next winning combination.

Many different winning combinations and paytables for the dice matrix can be used as may be desired by the game designer and/operator. In various embodiments, multiple pay tables can be available for use in a Crazy Dice Gaming System, so as to create different hold percentages for varying gaming establishments needs. Gaming operators can be allowed to use an operator menu to toggle and set various options and amounts for the paytables to be made available to players, as will be readily appreciated by those skilled in the art. In various embodiments, the applicable paytable(s) can be displayed in the games menu and rules for players to see.

Although various options, winning combinations, and amounts can be available an exemplary paytable will now be provided for purposes of illustration. It will be readily appreciated that many other paytables having different options, combinations, and pay amounts may alternatively be used. Such variations may be provided by the game designer in some embodiments, and may also be customizable for specific selections to be made by the gaming establishment or operator, as will be readily appreciated. By way of example, various embodiments can include a 5×5 dice matrix paytable such as the following:

3 of a Kind; pays 1-1
Full house; 2-1
Small Straight; 3-1
4 of a Kind; 5-1
Large Straight; 6-1
Scatter (8-15); 7-1
5 of a Kind; 100-1
Identical Rows/Columns; 250-1
Scatter (16-25); 10,000-1

It will be understood that a "small straight" is four consecutive dice on a payline (e.g., "1234"), and that a "Large Straight" is five consecutive dice on a payline (e.g., "23456"). As noted above, a "Scatter" wager can involve all dice across the entire matrix. By this paytable, any single dice roll (e.g., "5s") that appears 8 to 15 times across all 25 dice returns a 7-1 payout, and any single dice roll that appears 16 or more times across all 25 dice returns a 10,000-1 payout. Again, other winning combinations and other payout amounts are also possible, as may be desired.

In various embodiments, the primary game using a matrix of virtual dice can also provide for a "wild" die on occasion. In such arrangements, rather than a die rolling a 1, 2, 3, 4, 5, or 6 (for standard six-sided dice), a bonus or rare lucky roll may result in a die roll with a wild symbol. Such a wild die can be the best possible result for each of the row and column that the die is in, as well as for a scatter result. For example, a wild die might best be a "3" for its row payline, a "1" for its column payline, and a "6" for the scatter result or payline. The wild symbol used can be by default or can be customized for use with a given gaming vendor.

After the dice in the matrix are rolled for the play of the primary game, the outcomes for each payline are determined, and the awards for each winning payline are provided to the player. As will be readily appreciated, there may be none, one, several, or all paylines that result in some kind of award for any given play of the primary game using a matrix of dice. In various embodiments of the disclosed Crazy Dice Gaming System, the primary game may be played alone, such that awarding the player winnings and adjusting player credits at the end of the primary game thus ends the game. In further embodiments, however, a secondary game, a bonus game, or both may also take place in conjunction with the play of the primary game, as set forth below.

Secondary Game

In various embodiments a secondary game may be played along with the primary game. The secondary game may be automatically provided, or may be provided at the option of the player. For example, a player may elect to play only the primary game for a set of primary wagers, or may elect to play the secondary game as well. In some embodiments, play of the secondary game may involve an additional wager or credit requirement, while such requirement may not exist in other embodiments. Also, the secondary game may be played at the same time as the primary game, or may take place after the play of the primary game. In some arrangements, the primary game and the secondary game may take place at the same time and may be interactive.

The secondary game can include various items or devices that are separate from the primary game. In some embodiments, the secondary game can include the use of spinning virtual reels. Referencing FIG. 12, a flowchart of one exemplary method of providing a video type wager-based game involving a secondary game having reels is shown. It will be readily appreciated that the illustrated method provides a basic overview, and that further details and steps may be added, as set forth below. After a start step 1200, a process step 1202 involves providing to a player a video-based secondary game having virtual reels. The secondary game can include reels that correspond to dice columns in the primary game, for example. Further, each shown reel stop on a reel can correspond to one of the individual dice in the dice matrix of the primary game.

At a following process step 1204, an input can be accepted from the player regarding play of the secondary game, after which play of the secondary game can be facilitated at the next process step 1206. The play of the secondary game can include a random determination of the virtual reels. This can include determining a symbol for each reel stop position shown on each reel. At subsequent process step 1208, an outcome of the secondary game can be determined, and this outcome can be based upon the random determination of the virtual reels. The method then ends at end step 1210.

For the foregoing flowchart, it will be readily appreciated that not every method step provided is always necessary, and that further steps not set forth herein may also be included. For example, added steps can involve interacting with the primary game and/or providing a bonus game. Furthermore, the exact order of steps may be altered as desired, and some steps may be performed simultaneously. For example, steps 1206 and 1208 can be considered as being performed simultaneously in various embodiments. Not all steps are always necessary either. For example, step 1204 may not be performed in all embodiments, such as where the secondary game is provided automatically with the play of the primary game.

Figure 12:
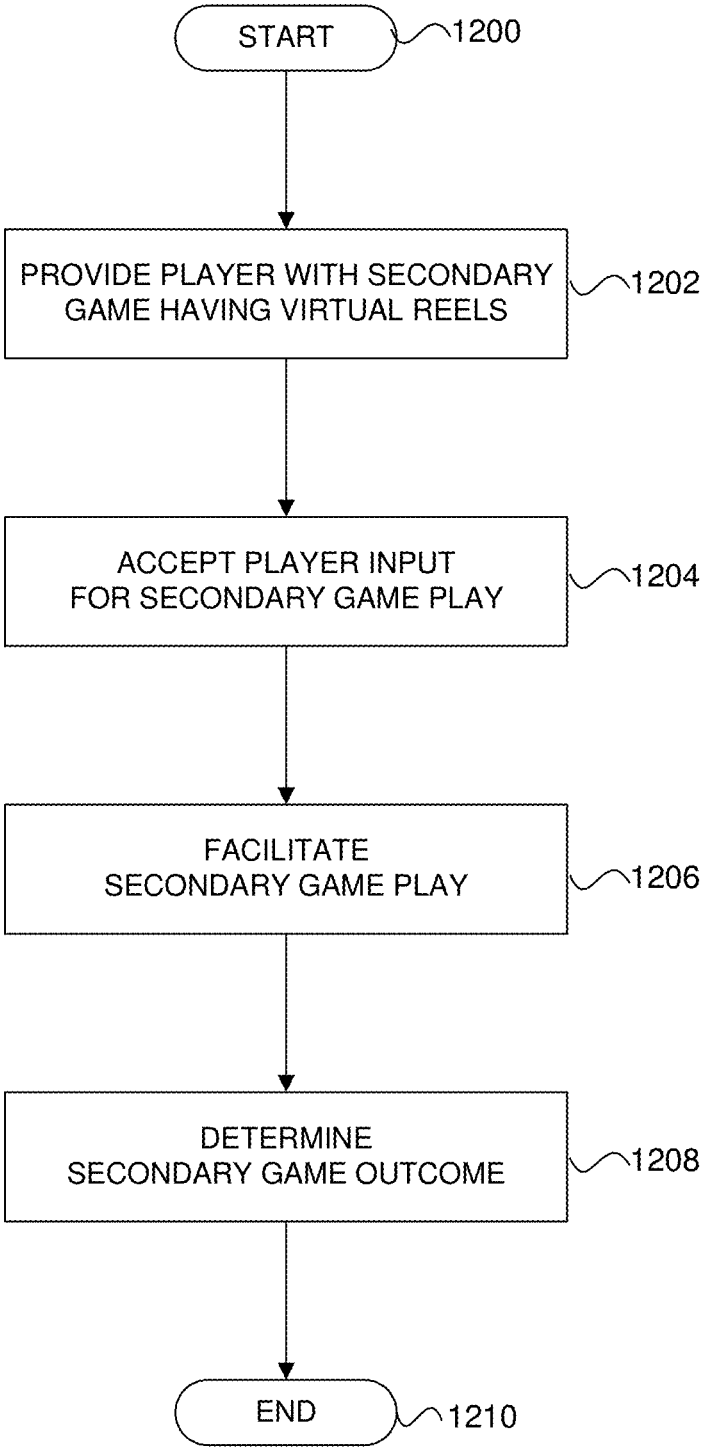
FIG. 12 illustrates a flowchart of an exemplary method of providing a video type wager-based game involving a secondary game having reels according to one embodiment of the present disclosure.

It will be appreciated that the steps set forth in FIG. 12 may refer to a secondary game played in conjunction with a primary game, and that other games may also be included, such as a bonus game, a progressive game, and others. Specific and non-limiting examples of the secondary game will now be provided. In one specific embodiment, the secondary game can include one virtual reel for each column of dice in the dice matrix of the primary game. Further, each of the virtual reels can have one reel stop position shown for each of the dice in the dice matrix. In the illustrative example provided herein using a 5×5 dice matrix, this would result in five reels, with each reel having five reel stop positions showing. Accordingly, when the virtual reels stop spinning in the secondary game, there can be 25 reel stop positions showing, with each reel stop position corresponding to one of the dice in the dice matrix of the primary game.

Figure 13:
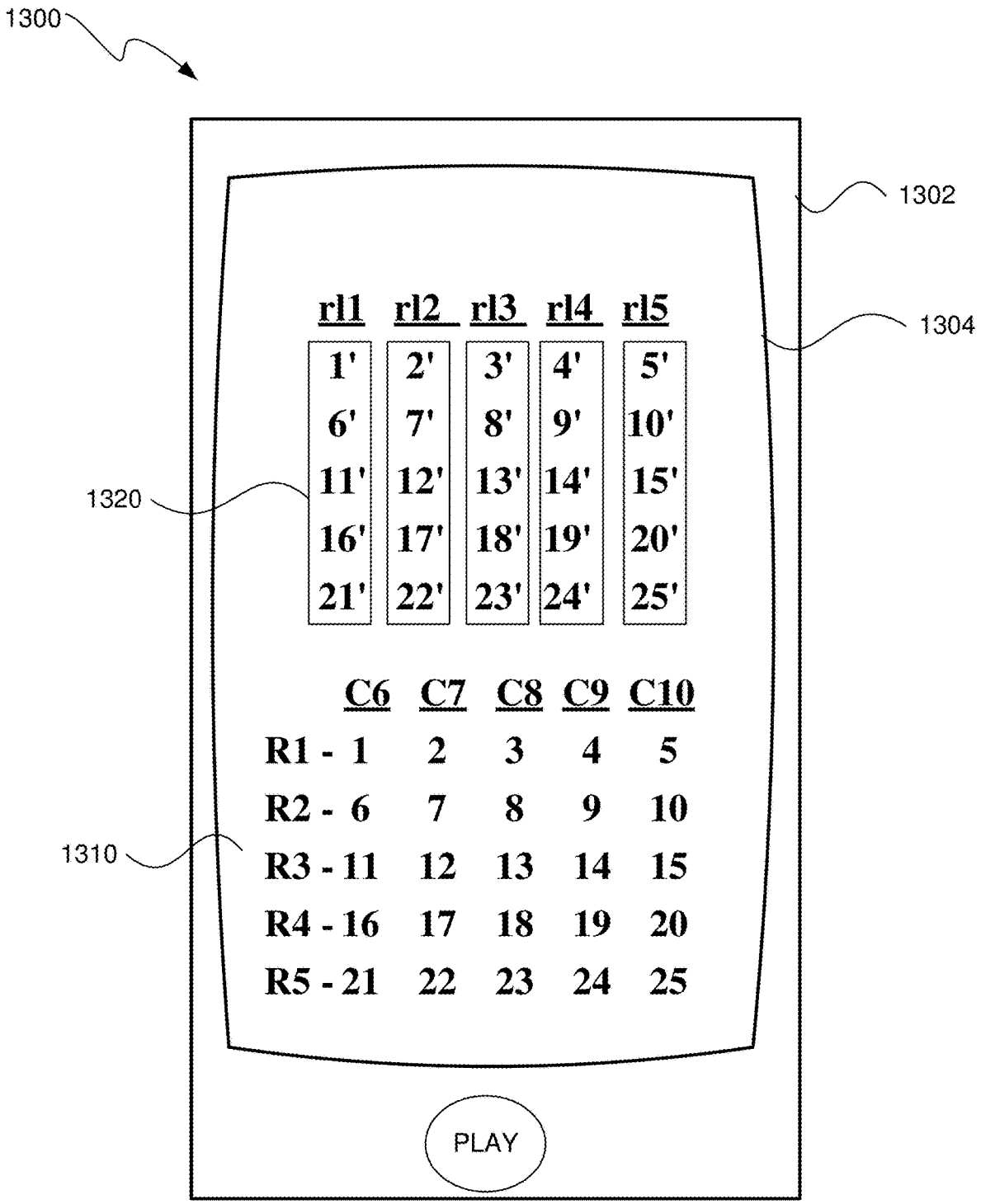
FIG. 13 illustrates a graphical representation of exemplary matrix positions for a wager-based game involving a primary game having dice and a secondary game having reels according to one embodiment of the present disclosure.

FIG. 13 illustrates a graphical representation of exemplary matrix positions for a wager-based game involving a primary game having dice and a secondary game having reels. Gaming system 1300 can include a gaming machine 1302 having a screen 1304, such as that which is shown for the various gaming systems above. A graphical representation of a matrix 1310 depicts the positions for 25 dice arranged into a 5×5 matrix for a primary game, similar to that which is discussed above. In addition, a graphical representation of a matrix 1320 depicts reels stop positions for 5 reels for a secondary game. As shown, there can be five reels (r11-r15), with each reels having five reel stop positions shown. Each reel can correspond to a column for the dice matrix (e.g., r11-C6), and each reel stop position can correspond to a die in the dice matrix (e.g., 14'-14). Similar arrangements can apply for different matrix sizes, as will be readily appreciated.

Various symbols can be provided for use on the virtual reels. Some of the reel symbols can correspond to a specific die, while others can simply be general, and still others can simply be blanks that result in nothing. Various reel symbols can include, for example, multipliers that correspond to specific dice, dice reroll triggers, bonus game triggers, progressive award triggers, blanks, and so forth. Specific features and results for various exemplary reel symbols are provided in greater detail below.

For embodiments that include a secondary game, the secondary game can be played simultaneously with or following the primary game. In such embodiments, initiating game play can trigger both the primary game and the secondary game to be played. Again, this can cause all of the virtual dice in the dice matrix to be randomly "rolled" or spun to create an outcome for the primary game. This can also cause all of the virtual reels to be randomly spun to create an outcome for the secondary game. This can be graphically represented on the game display in a variety of possible ways. Continuing with FIGS. 14A and 14B, screen shots of an exemplary video type wager-based game involving a primary game and a secondary game are provided.

Figure 14A:
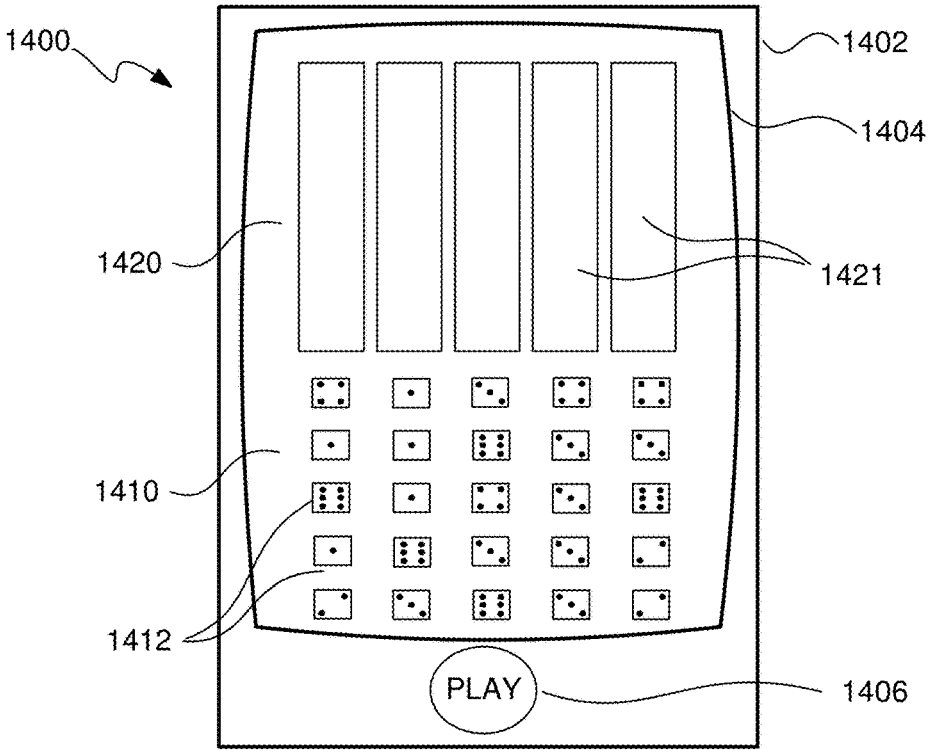
FIG. 14A illustrates a screen shot of an exemplary video type wager-based game involving a primary game having dice and a secondary game having reels prior to the play of a game according to one embodiment of the present disclosure.
Figure 14B:
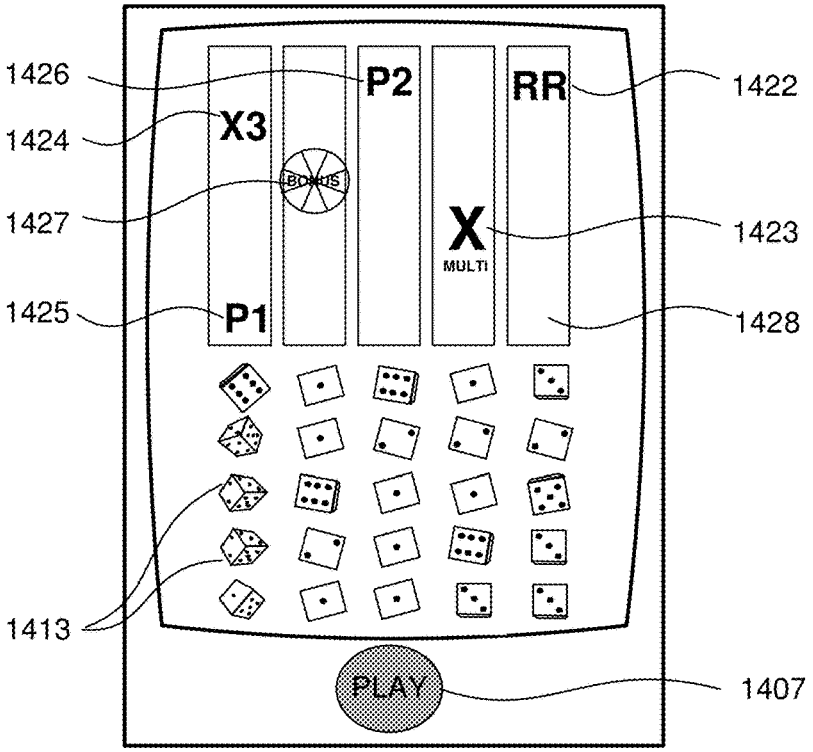
FIG. 14B illustrates a screen shot of an exemplary video type wager-based game involving a primary game having dice and a secondary game having reels during the play of a game according to one embodiment of the present disclosure.

FIG. 14A shows a primary game having a dice matrix and a secondary game having reels prior to the play of a game, while FIG. 14B shows a dice matrix and reels during the simultaneous play of the primary game and the secondary game. Similar to the foregoing embodiments, gaming system 1400 can include a gaming machine 1402 having a display screen 1404 and a play button input 1406. On the display screen 1404, a primary game 1410 can include multiple dice 1412 arranged into a 5×5 matrix, and a secondary game 1420 can include multiple reels 1421. Again, each reel in the secondary game 1420 can correspond to a column of dice in the primary game 1410.

After a player presses the play button input 1006 to initiate a game play, the dice 1412 can begin to roll or rotate, and the reels 1421 can begin to spin showing different cascading reel symbols. As shown in FIG. 14B, the play button input 1407 has been actuated, the dice 1413 in the matrix are all rolling, and the reels are spinning to display cascading reel symbols 1422, 1423, 1424, 1425, 1426, 1427, 1428. Although just one of each for several different types of reel symbols are shown, it will be readily appreciated that none or more than one of each symbol type can be present. It will also be readily appreciated that the spinning and cascading of reel symbols can be graphically animated until the reels all stop at a final result for each reel. Such a final result for the reels and reel symbols and the various reel stop positions can be randomly determined in software in any of a number of suitable ways, as will be understood by those of skill in the art.

Various embodiments of the disclosed Crazy Dice Gaming System can include a variety of different reel symbols. As shown, reel symbol 1422 can be a reroll symbol, reel symbol 1423 can be an X-multiplier reel symbol, reel symbol 1424 can be a specific number-multiplier reel symbol, reel symbol 1425 can be a first progressive reel symbol, reel symbol 1426 can be a second progressive reel symbol, reel symbol 1427 can be a bonus game reel symbol, and reel symbol 1428 can be a blank. Not all embodiments can include each of these different reel symbols, and other embodiments can include different reel symbols not shown here. Of course, the functions and results for each of the different types of reel symbols can be listed in the game rules and paytable(s) created for the different Crazy Dice Gaming System games. Details for each of the exemplary illustrated reel symbols will now be provided.

In various embodiments, the result for a blank reel symbol 1428 can be nothing. Such a blank reel symbol can be the final result for many or most secondary game outcomes in some arrangements. The bonus game reel symbol 1427 can result in the award of a bonus game if certain conditions are met. For example, a bonus game can be awarded in the event that five or more bonus game reel symbols appear across all 25 reel stop positions in the outcome of the secondary game. Other conditions may also be used regarding the use of the bonus game reel symbol 1427 and the award of a bonus game play. For example, fewer or more bonus game reel symbols may be required to trigger the award of a bonus game play. Also, more bonus game reels symbols may result in the award of multiple bonus game plays. Further details regarding the play of a bonus game are provided below.

First progressive reel symbol 1425 and second progressive reel symbol 1426 can result in the award of a progressive payout if certain conditions are met. For example, a first progressive award can be granted to the player if five or more of the first progressive reel symbols appear across all 25 reel stop positions in the outcome of the secondary game. A similar requirement can apply for a second progressive award with respect to the appearance of the second progressive reel symbols. Similarly, fewer or more of these reel symbols may be required to trigger the progressive awards.

The appearance of any "specific number-multiplier" reel symbol 1424 can result in a specific multiplier being applied to any payout involving a corresponding die. For example, a X3 multiplier symbol for a given reel stop position can be applied to the die corresponding to that symbol, resulting in a triple payout for any award involving that die. As shown, an X3 multiplier can appear at reel stop position 6', which can then result in a triple payout for any award involving the die at position 6 in the dice matrix. Other specific multiplier numbers can also be provided for specific number-multiplier reel symbols, such as X2, X5, X10, and the like.

Similarly, the appearance of any "X-multiplier" reel symbol 1423 can also result in a multiplier being applied to any payout involving a corresponding die. Rather than a specific number multiplier, however, an X-multiplier reel symbol uses the value of the corresponding die to determine the multiplier. For example, if the corresponding die has a value of 4, then the multiplier is 4 for any award involving that die. In this manner, a multiplier of 6 would apply for a die value of 6, while a multiplier of only 1 (i.e., no multiplier) would apply for a die value of 1 at the corresponding die.

Reroll reel symbols 1422 can add additional excitement to the play of the game in a Crazy Dice Gaming System. The presence of such reroll reel symbols 1422 in the secondary game can allow for the possible rerolling of one or more dice in the primary game. In some embodiments, each reroll symbol 1422 can allow for a player option to reroll the die corresponding to the position of the reroll symbol 1422. As shown in FIG. 14B, a reroll symbol 1422 appearing in the outcome of the secondary game at position 5' can allow the player to reroll the die at position 5 in the dice matrix. In the event that the player elects to reroll this die, this can change the outcome for the R1 payline, the C10 payline, and the scatter award. In the event that multiple reroll symbols 1422 appear in the outcome of the secondary game, the player can be allowed to elect to reroll or not reroll each die corresponding to a reroll symbol 1422. Of course, a final outcome determination and awards for the primary game can be delayed pending any rerolls in the event that such rerolls are made available to the player. In this manner, an element of skill can be provided to the player in deciding whether or not to reroll one, some, or all of the dice that may possibly be rerolled.

In various further embodiments, the reroll symbols may be used in a different manner to provide even more skill to the player in deciding whether or not to reroll dice. Rather than forcing a reroll only for corresponding dice, the presence of a reroll symbol can allow for the player to select any of the dice to be rerolled. For example, if three reroll symbols appear in the outcome for the secondary game, then the player may choose up to three dice in the entire dice matrix to be rerolled. A skillful selection by the player can then maximize chances for different outcomes or even a big win.

In various embodiments, the ability to reroll any dice in the matrix might not be triggered unless a sufficient number of reroll symbols appear. For example, no rerolls might be allowed unless at least five reroll symbols appear. In the event that five reroll symbols do appear on the virtual reels for the outcome of the secondary game, then up to five dice anywhere in the matrix may be selected for a reroll. In some embodiments, more than five reroll symbols can result in allowing even more dice to be rerolled. For example, the appearance of seven reroll symbols might allow up to seven dice to be rerolled. Of course, the threshold for allowing rerolls need not be five, but could instead be two, three or some other number of reroll symbols appearing in the outcome of the secondary game. By allowing the player to select dice to be rerolled in the primary game, a level of skill can be provided to the player in the play of the game, since the player may elect to reroll less dice than the total amount allowed, and may be strategic about which dice are rerolled.

Bonus Game

In various embodiments a bonus game may be played along with the primary game, the secondary game, or both. The bonus game may be automatically provided, or may be provided at the option of the player. For example, a player may elect to play only the primary game and possibly a secondary game for a set of primary wagers, or may elect to be eligible for the bonus game as well. In some embodiments, eligibility to possibly play the bonus game may involve an additional wager or credit requirement, while such requirement may not exist in other embodiments. In various embodiments, the bonus game may take place after the play of the primary game and secondary game, if applicable.

Figure 15:
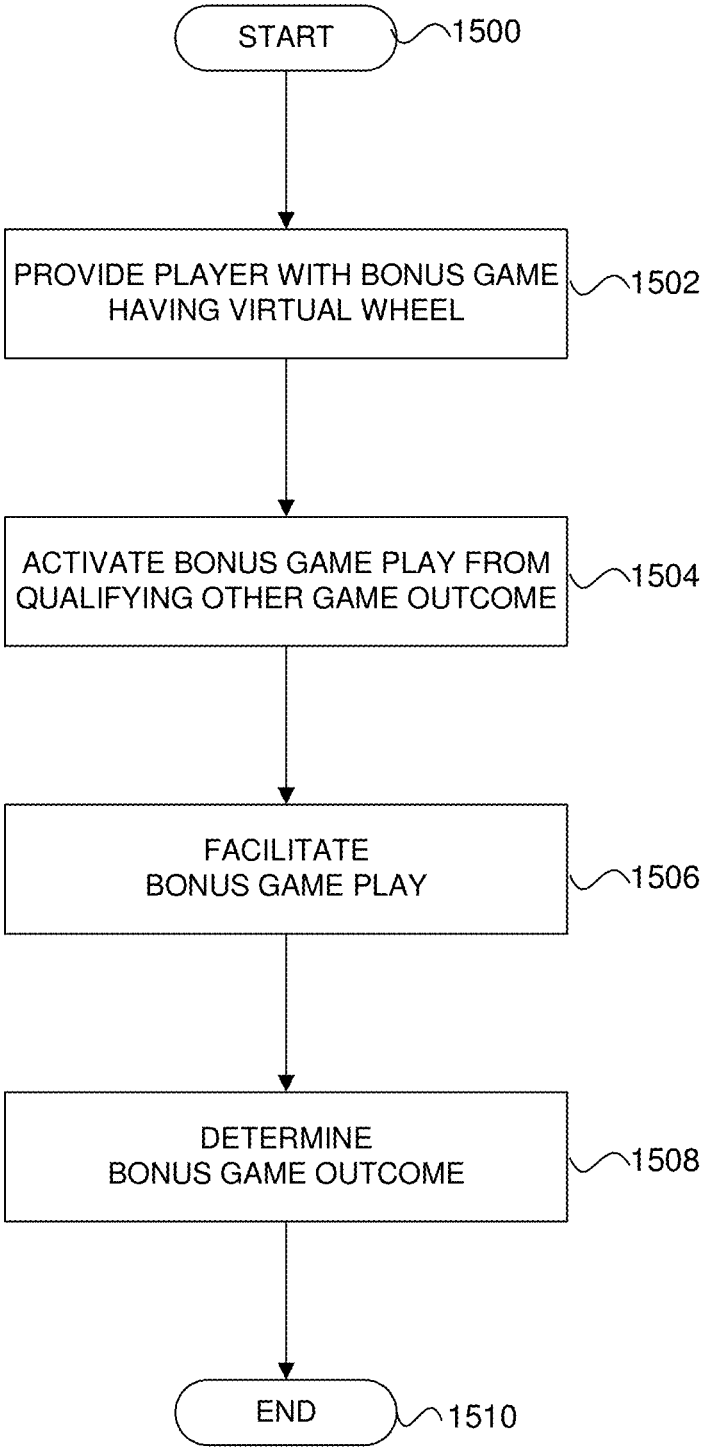
FIG. 15 illustrates a flowchart of an exemplary method of providing a video type wager-based game involving a bonus game having a wheel according to one embodiment of the present disclosure.

The bonus game can include various items or devices that are separate from the primary game and/or secondary game. In some embodiments, the bonus game can include the use of a rotating virtual wheel. FIG. 15 depicts a flowchart of an exemplary method of providing a video type wager-based game involving a bonus game having a wheel. It will be readily appreciated that the illustrated method provides a basic overview, and that further details and steps may be added. After a start step 1500, a process step 1502 involves providing to a player a video-based bonus game having a virtual wheel. The virtual wheel can have a plurality of sections with different prizes awards, and can be arranged to rotate in a clockwise or counter-clockwise fashion.

At a following process step 1504, a bonus game can be activated after a qualifying outcome from another game, after which play of the bonus game can be facilitated at the next process step 1206. The qualifying outcome can be a result of the secondary game, the primary game, or both. For example, the presence of five or more bonus game reel symbols in the outcome of the secondary game can be a qualifying outcome to activate or trigger the bonus game. The play of the bonus game can include a random determination of the virtual wheel. This can include determining where the wheel should stop rotating to indicate the appropriate result or award. At subsequent process step 1508, an outcome of the secondary game can be determined, which can be based upon the random determination of the virtual wheel. The method then ends at end step 1510.

For the foregoing flowchart, it will be readily appreciated that not every method step provided is always necessary, and that further steps not set forth herein may also be included. For example, added steps can involve accepting a player input to establish bonus game eligibility and/or providing an award to the player based on the bonus game outcome. Furthermore, the exact order of steps may be altered as desired, and some steps may be performed simultaneously. For example, steps 1506 and 1508 can be considered as being performed simultaneously in various embodiments. Not all steps are always necessary either. For example, various steps may not be performed in the player has not elected to be eligible for the bonus game where such election is required.

It will be appreciated that the steps set forth in FIG. 15 may refer to a bonus game played in conjunction with a primary game and/or secondary game, and that other games may also be included, such as a progressive game or other game. Specific and non-limiting examples of a bonus game will now be provided. In one specific embodiment, the bonus game can include a singular rotating virtual wheel. In the illustrative example provided, the bonus game can be depicted above the secondary game, which in turn is depicted above the primary game.

Figure 16A:
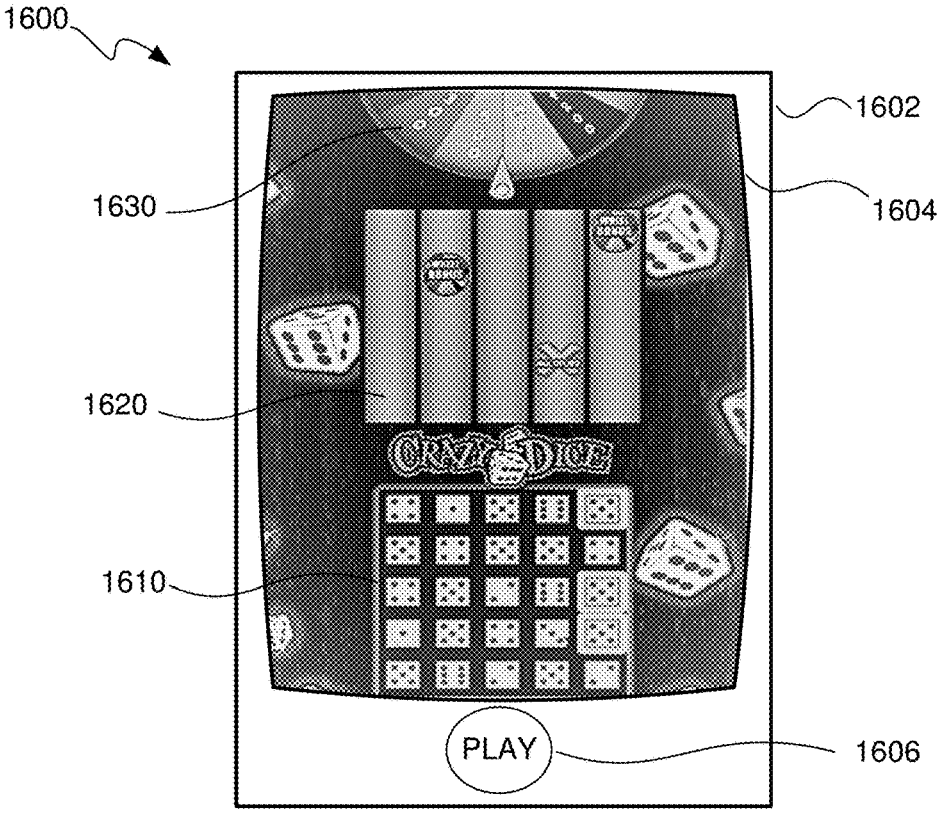
FIG. 16A illustrates a screen shot of an exemplary video type wager-based game involving a primary game having dice, a secondary game having reels, and a bonus game having a wheel prior to the play of a game according to one embodiment of the present disclosure.
Figure 16B:
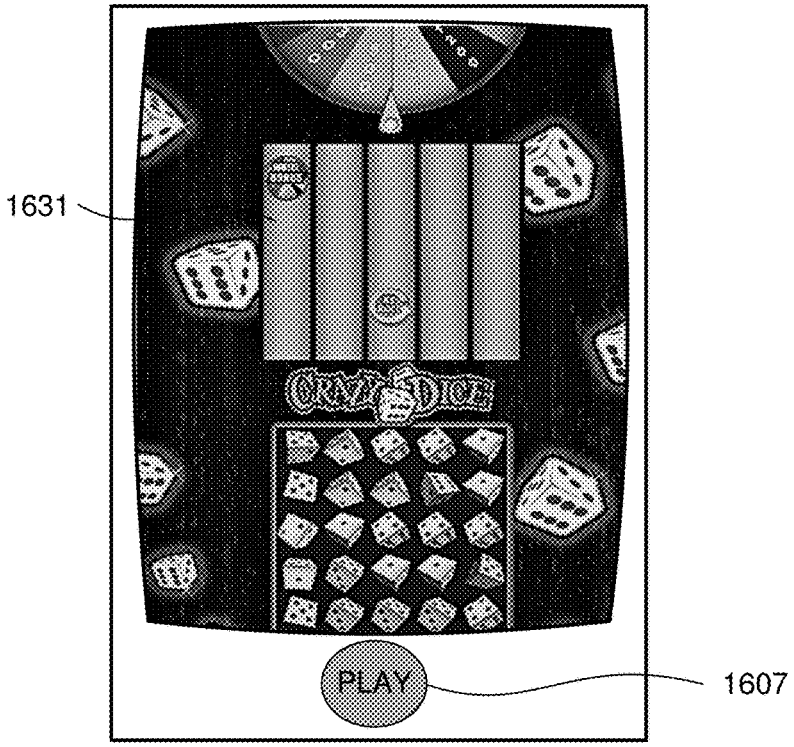
FIG. 16B illustrates a screen shot of an exemplary video type wager-based game involving a primary game having dice, a secondary game having reels, and a bonus game having a wheel during the play of a game according to one embodiment of the present disclosure.

FIG. 16A illustrates a screen shot of an exemplary video type wager-based game involving a primary game having dice, a secondary game having reels, and a bonus game having a wheel prior to the play of a game. Similar to the foregoing embodiments, gaming system 1600 can include a gaming machine 1602 having a display screen 1604 and various inputs, such as a play button 1606. The display screen 1604 can show a primary game 1610 having dice, a secondary game 1620 having reels, and a bonus game 1630 having a wheel. FIG. 16B illustrates a screen shot of an exemplary video type wager-based game involving a primary game having dice, a secondary game having reels, and a bonus game having a wheel during the play of a game according to one embodiment of the present disclosure. Similar to the foregoing embodiments, play button input 1607 has been actuated, such that the dice in the primary game are rolling and the reels are spinning. In some embodiments, the bonus wheel 1631 may also be rotating. In other embodiments, the bonus wheel does not rotate until a bonus game has actually been awarded.

As can be seen, various sections of the bonus wheel 1631 can award different bonus prizes to the player. These can include set monetary or credit amounts, as well as different jackpot awards. Such jackpot awards can include a "Mini" jackpot, a "Maxi" jackpot and a "Mega" jackpot. The amounts of these jackpots may vary and can be posted on the display screen or elsewhere near the gaming machine for the benefit of players.

Figure 17:
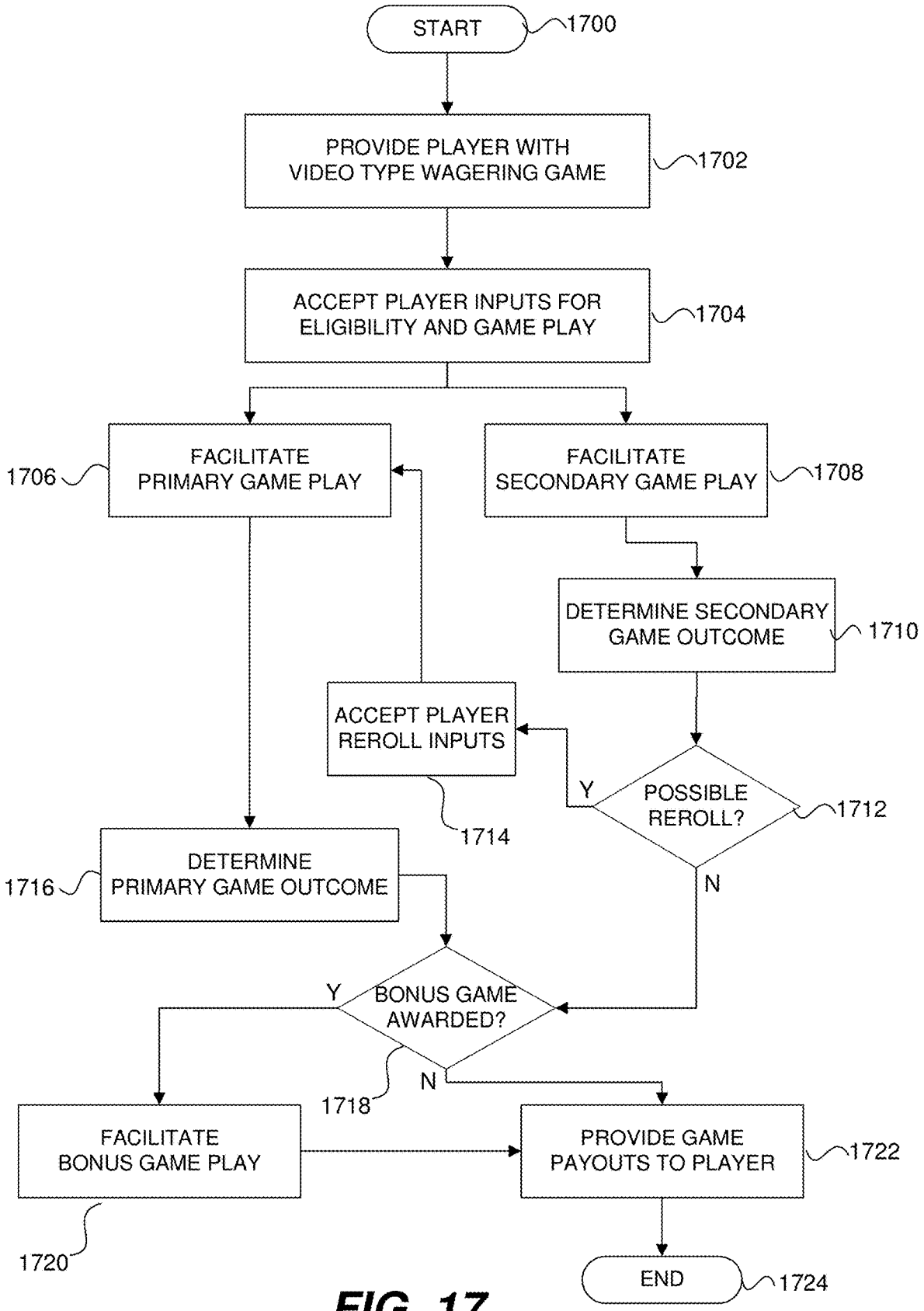
FIG. 17 illustrates a flowchart of an exemplary method of providing a video type wager-based game with a primary game having dice, a secondary game having reels, and a bonus game having a wheel according to one embodiment of the present disclosure.

Turning lastly to FIG. 17, a flowchart of an exemplary method of providing a video type wager-based game with a primary game having dice, a secondary game having reels, and a bonus game having a wheel is illustrated. Again, the disclosed method is provided only by way of example, and further steps and details may be added. Also, various steps may be omitted in some arrangements. After a start step 1700, a process step 1702 involves providing to a player a video type wagering game. Such a game can be that which is detailed above, which can include a primary game, a secondary game, and a bonus game, for example.

At a following process step 1704, player inputs can be accepted for game play. These player inputs can include wager choices and amounts for each payline and scatter play, as well as selections as to whether the secondary game, bonus game, or both will be played, if such selections are required. Further player input can involve actuating a play button to begin the play sequence. The next process steps 1706 and 1708 can take place at the same time and be performed in parallel. Process step 1706 can be to facilitate play of the primary game, which can be a dice based game such as that which is set forth above in greater detail. Process step 1708 can be to facilitate play of the secondary game, which can be a reel based game such as that which is also set forth above in greater detail.

Following process step 1708, the outcome of the secondary game can be determined at process step 1710. After step 1710, an inquiry can then be made at decision step 1712 as to whether a possible reroll may exist for the dice in the primary game. If not, then the method continues to decision step 1718 where the outcome from process step 1716 awaits before further proceeding. If a possible reroll does exist at decision step 1712, however, then the method continues to process step 1714, where further player inputs are accepted regarding the dice reroll(s). After step 1714, the method then continues to process step 1706, where the play of the primary game is further facilitated according to the reroll selections.

After process step 1706, with or without reroll considerations, the method continues to process step 1716, where the outcome of the primary game is determined, after which the method moves to decision step 1718. At step 1718, an inquiry can be made as to whether a bonus game play or plays have been awarded to the player. If so, then the method continues to process step 1720 where the bonus game play(s) are facilitated.

After steps 1718 and 1720, the method moves to process step 1722, where game payouts are provided to the player according to any wins in any of the primary, secondary and bonus games. Such payouts can be added to the credit meter for the player on the gaming machine, for example. The method then ends at end step 1724.

For the foregoing flowchart, it will be readily appreciated that not every method step provided is always necessary, and that further steps not set forth herein may also be included. For example, added steps can involve accepting player wagering monies or credits, accepting player setting preferences, and providing player awards in the form of cash or printed ticket. Furthermore, the exact order of steps may be altered as desired, and some steps may be performed simultaneously. Not all steps are always necessary either.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, flash drives, USB drives, CD-ROMs, DVDs, magnetic disk drives, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A wager-based gaming system, comprising:

an interface configured for communication with a player of the wager-based gaming system;

a memory; and a controller coupled to the interface and the memory, wherein the controller is configured to execute a plurality of instructions stored in the memory for:

providing a video-based wagering game including a primary game, the primary game involving virtual dice arranged in a matrix having multiple rows and multiple columns, wherein each of the virtual dice is positioned in exactly one row and exactly one column;

accepting an input from the player regarding play of the primary game;

facilitating play of the primary game, wherein play of the primary game includes a random determination of the virtual dice;

determining an outcome of the primary game, wherein the outcome of the primary depends upon the random determination of the virtual dice;

providing a secondary game related to the primary game, the secondary game involving virtual reels, wherein an outcome of the secondary game affects the outcome of the primary game;

wherein the secondary game includes one virtual reel for each column of dice in the dice matrix of the primary game, and wherein each virtual reel includes one reel stop position for each of the dice in the dice matrix;

facilitating play of the secondary game, wherein play of the secondary game includes a random determination of the virtual reels, and wherein initiating game play triggers the start and simultaneous play of both the primary game and the secondary game; and determining the outcome of the secondary game, wherein the outcome of the secondary game depends upon the random determination of the virtual reels, with at least one possible outcome of the secondary game allowing skill-based player changes to the outcome of the primary game, and at least one possible outcome of the secondary game not allowing player changes to the outcome of the primary game.

2. The wager-based gaming system of claim 1, wherein the controller is further configured to execute instructions stored in the memory for:

providing a bonus game associated with the secondary game;

awarding a bonus game play based on a winning outcome of the secondary game, wherein the winning outcome does not include all possible outcomes of the secondary game; and determining an outcome of the bonus game play.

3. The wager-based gaming system of claim 2, wherein the bonus game involves spinning a virtual wheel.

4. The wager-based gaming system of claim 1, wherein the matrix includes exactly five rows and exactly five columns.

5. The wager-based gaming system of claim 1, wherein the outcome of the primary game includes a row sub-outcome for each row of the matrix and a column sub-outcome for each column of the matrix.

6. The wager-based gaming system of claim 5, wherein the outcome of the primary game further includes a scatter sub-outcome for all dice in the matrix.

7. The wager based gaming system of claim 1, wherein each reel symbol in the secondary game corresponds to a specific die in the primary game.

8. The wager based gaming system of claim 7, wherein a reroll symbol in the secondary game allows the player to reroll the specific die in the primary game to which that reroll symbol corresponds.

9. The wager based gaming system of claim 1, wherein the secondary game includes reroll reel symbols that allow for dice rerolls in the primary game, bonus game reel symbols that trigger the addition of a bonus game that is separate from the primary game and the secondary game, and multiplier reel symbols that trigger multipliers with respect to awards in the primary game.

10. The wager based gaming system of claim 1, wherein a player may elect not to use the secondary game, the bonus game, or both for a particular game play.

11. The wager based gaming system of claim 1, wherein the player changes include selecting one or more of the virtual dice in the matrix to be re-rolled, and wherein the selected number of the virtual dice in the matrix to be re-rolled is fewer than the maximum number of virtual dice allowed to be re-rolled.

12. The wager based gaming system of claim 1, wherein the virtual dice are three-dimensional and play of the primary game includes virtually rolling all of the three-dimensional virtual dice in place within the matrix to arrive at the random determination of the three-dimensional virtual dice.

13. The wager based gaming system of claim 1, wherein the input from the player initiates the play of both the primary game and the secondary game.

14. The wager based gaming system of claim 1, wherein the secondary game affects the primary game and the bonus game but does not provide its own separate award.

15. A computer readable medium including at least computer program code for presenting a wager-based game using a computing apparatus, the computer readable medium comprising:

computer program code for providing to a player via a computing apparatus a video-based wagering game including a primary game, the primary game involving virtual dice arranged in a matrix having multiple rows and multiple columns, wherein each of the virtual dice is positioned in exactly one row and exactly one column;

computer program code for accepting an input from the player regarding play of the primary game;

computer program code for facilitating play of the primary game, wherein play of the primary game includes a random determination of the virtual dice;

computer program code for determining an outcome of the primary game based upon the random determination of the virtual dice;

computer program code for providing a secondary game related to the primary game, the secondary game involving virtual reels, wherein an outcome of the secondary game affects the outcome of the primary game;

wherein the secondary game includes one virtual reel for each column of dice in the dice matrix of the primary game, and wherein each virtual reel includes one reel stop position for each of the dice in the dice matrix;

computer program code for facilitating play of the secondary game, wherein play of the secondary game includes a random determination of virtual reels, and wherein initiating game play triggers both the primary game and the secondary game to be played at the same time; and computer program code for determining the outcome of the secondary game, wherein the outcome of the secondary game depends upon the random determination of the virtual reels, with at least one possible outcome of the secondary game allowing skill-based player changes to the outcome of the primary game, and at least one possible outcome of the secondary game not allowing player changes to the outcome of the primary game.

16. The computer readable medium of claim 15, further comprising:

computer program code for providing to the player via the computing apparatus a bonus game associated with the secondary game;

computer program code for awarding a bonus game play to the player based on a winning outcome of the secondary game, wherein the winning outcome does not include all possible outcomes of the secondary game; and computer program code for determining an outcome of the bonus game play.

17. The computer readable medium of claim 15, wherein the outcome of the secondary game grants the player the ability to select one or more of the virtual dice in the matrix to be re-rolled.

18. A method of providing a wager-based game using a computing apparatus, the method comprising:

providing to a player via a video-based wagering game including a primary game, the primary game involving virtual dice arranged in a matrix having multiple rows and multiple columns, wherein each of the virtual dice is positioned in exactly one row and exactly one column;

accepting an input from the player regarding play of the primary game; facilitating play of the primary game, wherein play of the primary game includes a random determination of the virtual dice;

determining an outcome of the primary game based upon the random determination of the virtual dice;

providing a secondary game related to the primary game, the secondary game involving virtual reels;

wherein the secondary game includes one virtual reel for each column of dice in the dice matrix of the primary game, and wherein each virtual reel includes one reel stop position for each of the dice in the dice matrix;

facilitating play of the secondary game, wherein play of the secondary game includes a random determination of the virtual reels, wherein initiating game play triggers both the primary game and the secondary game to be played at the same time, and wherein an outcome of the secondary game affects the outcome of the primary game; and determining the outcome of the secondary game, wherein the outcome of the secondary game depends upon the random determination of the virtual reels, with at least one possible outcome of the secondary game allowing skill-based player changes to the outcome of the primary game, and at least one possible outcome of the secondary game not allowing player changes to the outcome of the primary game.

19. The method of claim 18, further comprising:

providing to the player a bonus game associated with the secondary game;

awarding a bonus game play to the player based on a winning outcome of the secondary game, wherein the winning outcome does not include all possible outcomes of the secondary game; and determining an outcome of the bonus game play.

* * * * *